US010350506B2

(12) United States Patent
Pridonoff

(10) Patent No.: US 10,350,506 B2
(45) Date of Patent: Jul. 16, 2019

(54) PORTABLE FOLDING PLAY STRUCTURE

(71) Applicant: READYSETZ, LLC, Dana Point, CA (US)

(72) Inventor: Charles L. Pridonoff, Dana Point, CA (US)

(73) Assignee: READYSETZ, LLC, Dana Point, CA (US)

( * ) Notice: Subject to any disclaimer, the term of this patent is extended or adjusted under 35 U.S.C. 154(b) by 0 days.

(21) Appl. No.: 15/956,437

(22) Filed: Apr. 18, 2018

(65) Prior Publication Data

US 2019/0091595 A1 Mar. 28, 2019

Related U.S. Application Data

(60) Provisional application No. 62/566,929, filed on Oct. 2, 2017, provisional application No. 62/606,129, filed on Apr. 19, 2017.

(51) Int. Cl.
*A63H 33/04* (2006.01)
*A63H 33/00* (2006.01)
(Continued)

(52) U.S. Cl.
CPC ..... *A63H 33/008* (2013.01); *A63H 33/044* (2013.01)

(58) Field of Classification Search
CPC . A63H 3/00; A63H 3/005; A63H 3/52; A63H 33/008; A63H 33/044; A63H 33/04;
(Continued)

(56) References Cited

U.S. PATENT DOCUMENTS 243,873 A 7/1881 Dorn et al.
255,257 A 3/1882 Smith et al.
(Continued)

FOREIGN PATENT DOCUMENTS

EP 0555188 8/1993
GB 156469 1/1921
(Continued)

*Primary Examiner* — Kien T Nguyen
(74) *Attorney, Agent, or Firm* — Knobbe Martens Olson & Bear LLP

(57) ABSTRACT

A collapsible play structure having a collapsed configuration and an opened configuration comprises: a left panel having a back surface, a front surface, a horizontal axis, and a vertical axis; a left fold out structure coupled to the left panel, the left fold out structure comprising one or more members rotatably coupled to the left panel to be rotatable about an axis parallel with the horizontal axis of the left panel; a right panel having a back surface, a front surface, a horizontal axis, and a vertical axis; a right fold out structure coupled to the right panel, the right fold out structure comprising one or more members rotatably coupled to the right panel to be rotatable about an axis parallel with the horizontal axis of the right panel; and a center panel having a back surface and a front surface, the center panel rotatably coupled to the left panel and the right panel in an orientation that aligns the vertical axes of the left panel and the right panel in a parallel alignment, wherein, in the opened configuration, the left fold out structure and right fold out structure are coupled together by at least one releasable joint.

9 Claims, 26 Drawing Sheets

(51) Int. Cl.
*A63H 3/00* (2006.01)
*E04H 15/00* (2006.01)

(58) Field of Classification Search
CPC ..... A63H 33/16; A63H 33/38; E04H 15/00; E04H 15/54; E04H 15/40
USPC ..... 446/148, 478, 488, 487; 40/124.09, 40/124.12, 539
See application file for complete search history.

(56) References Cited

U.S. PATENT DOCUMENTS

| | | | | | |
|---|---|---|---|---|---|
| 326,690 | A | | 9/1885 | Hamzik | |
| 347,682 | A | | 8/1886 | Buckingham | |
| 500,848 | A | | 7/1893 | Breul | |
| 984,735 | A | | 2/1911 | Bailey | |
| 1,586,191 | A | | 5/1926 | Fritzsche | |
| 1,630,117 | A | | 5/1927 | Faulkner | |
| 1,723,944 | A | * | 8/1929 | Marsh | A47F 5/112 211/73 |
| 1,742,905 | A | | 1/1930 | Friedel | |
| 1,801,724 | A | | 4/1931 | Conklin | |
| 1,867,374 | A | | 7/1932 | Myers | |
| 1,889,468 | A | | 11/1932 | Flannery | |
| 1,891,011 | A | | 12/1932 | Purdy | |
| 1,959,619 | A | | 5/1934 | Ebert | |
| 2,112,474 | A | | 4/1937 | Warren | |
| 2,204,264 | A | * | 6/1940 | Warren | A63H 33/044 446/109 |
| 2,232,953 | A | | 2/1941 | Mallgraf | |
| 2,544,783 | A | | 3/1951 | Freedman et al. | |
| 2,556,323 | A | | 6/1951 | Feigelman | |
| 2,661,559 | A | | 12/1953 | Klein et al. | |
| 3,343,297 | A | | 9/1967 | Valentine | |
| 3,629,969 | A | | 12/1971 | Dodd | |
| 4,435,915 | A | | 3/1984 | Zaruba et al. | |
| 4,759,520 | A | | 7/1988 | Levine | |
| 4,778,392 | A | * | 10/1988 | Mitchell | G09B 1/00 206/509 |
| 4,850,060 | A | | 7/1989 | Kou | |
| 4,883,443 | A | | 11/1989 | Chase | |
| 5,055,083 | A | | 10/1991 | Walker et al. | |
| 5,317,823 | A | | 6/1994 | Brunt, II | |
| D360,435 | S | | 7/1995 | Pridonoff et al. | |
| D364,200 | S | | 11/1995 | Pridonoff et al. | |
| 5,562,520 | A | | 10/1996 | Pridonoff et al. | |

FOREIGN PATENT DOCUMENTS

| | | |
|---|---|---|
| GB | 379486 | 9/1932 |
| GB | 399253 | 10/1933 |
| GB | 2239171 | 6/1991 |
| WO | WO 93/23254 | 11/1993 |

* cited by examiner

700

PORTABLE FOLDING PLAY STRUCTURE

CROSS-REFERENCE TO RELATED APPLICATIONS

This application claims the benefit of U.S. Provisional Application No. 62/566,929, titled PORTABLE FOLDING PLAY STRUCTURE, filed Oct. 2, 2017; and U.S. Provisional Application No. 62/606,129, titled PORTABLE FOLDING PLAY STRUCTURE, filed Apr. 19, 2017. Each of the foregoing applications is hereby incorporated by reference herein in its entirety

BACKGROUND

Field

This invention relates generally to the field of toys and more specifically to children's play structures.

Description

Children all over the world engage in imaginative play using scale models of people, cars, animals and other play figures. To facilitate the play process, various types of three dimensional structures have been designed and sold, such as doll houses and other scaled down environments such as auto garages, kitchens, and fire houses.

SUMMARY

This disclosure presents various embodiments of portable folding play structures. The portable folding play structures can comprise a collapsed or storage configuration and an open or expanded configuration. In some embodiments, when the portable folding play structure is in the collapsed configuration, the play structure is smaller than in the open configuration, in order to more easily be stored and transported. When a child is ready to play with the play structure, the portable play structure can be expanded into the open or expanded configuration to form a three-dimensional play structure.

According to some embodiments, a collapsible play structure having a collapsed configuration and an opened configuration comprises: a left panel having a back surface, a front surface, a horizontal axis, and a vertical axis; a left fold out structure coupled to the left panel, the left fold out structure comprising one or more members rotatably coupled to the left panel to be rotatable about an axis parallel with the horizontal axis of the left panel; a right panel having a back surface, a front surface, a horizontal axis, and a vertical axis; a right fold out structure coupled to the right panel, the right fold out structure comprising one or more members rotatably coupled to the right panel to be rotatable about an axis parallel with the horizontal axis of the right panel; and a center panel having a back surface and a front surface, the center panel rotatably coupled to the left panel and the right panel in an orientation that aligns the vertical axes of the left panel and the right panel in a parallel alignment, wherein, in the opened configuration, the left fold out structure and right fold out structure are coupled together by at least one releasable joint.

In some embodiments, the center panel is rotatably coupled to the left panel via a left hinge panel, the center panel is rotatably coupled to the right panel via a right hinge panel, and the collapsible play structure further comprises a connecting panel rotatably coupled to the center panel by a hinge joint that allows the connecting panel to rotate with respect to the center panel about an axis that is perpendicular to the vertical axes of the left panel and right panel, wherein, in the opened configuration, the connecting panel is coupled to the left fold out structure by at least one releasable joint, and the connecting panel is coupled to the right fold out structure by at least one releasable joint. In some embodiments, left and right hinge panels each comprise a width, and one of the left and right hinge panels is wider than the other of the left and right hinge panels. In some embodiments, the widths of the left and right hinge panels are sufficiently large to enable the back surface of the left panel, the back surface of the center panel, and the back surface of the right panel to all be in a parallel alignment when the collapsible play structure is in the collapsed configuration. In some embodiments, the left fold out structure is positioned to be collapsed toward the front surface of the left panel when the collapsible play structure is in the collapsed configuration, and to be expanded away from the front surface of the left panel when the collapsible play structure is in the opened configuration, and the right fold out structure is positioned to be collapsed toward the front surface of the right panel when the collapsible play structure is in the collapsed configuration, and to be expanded away from the front surface of the right panel when the collapsible play structure is in the opened configuration. In some embodiments, each panel comprises corrugated cardboard.

According to some embodiments, a portable folding play structure comprises: a plurality of sheets of corrugated cardboard, said sheets die cut and scored to create a foldable structure that when unfolded creates a play structure, said play structure including a left side wall, a center wall and a right side wall, said left side wall and said right side wall held to said center wall by left and right integral hinge strips formed by scoring said corrugated cardboard, said left and right side walls including fold down structures that create multi-tiered play surfaces, said center wall including a fold down X member, and said X member having scored ends that insert into slots in horizontal tiered play surfaces causing said left and right walls to be rigidly locked in place in a right angle condition with relation to each other.

In some embodiments, said fold down structures automatically fall into place by gravitational force. In some embodiments, said right side wall and said left side wall can fold over said center wall via said hinges to form a relatively flat compact structure that is ideal for storage and shipping. In some embodiments, the portable folding play structure further comprises a plurality of stairs, ramps, windows, doors and/or tunnels formed by scores in said sheets of corrugated cardboard.

BRIEF DESCRIPTION OF THE DRAWINGS

The foregoing and other features, aspects, and advantages of the present inventions are described in detail below with reference to the drawings of various embodiments, which are intended to illustrate and not to limit the inventions. It is to be understood that in some instances various aspects of the inventions may be shown exaggerated or enlarged to facilitate an understanding of the inventions. The drawings comprise the following figures in which.

DETAILED DESCRIPTION

Figure 1:
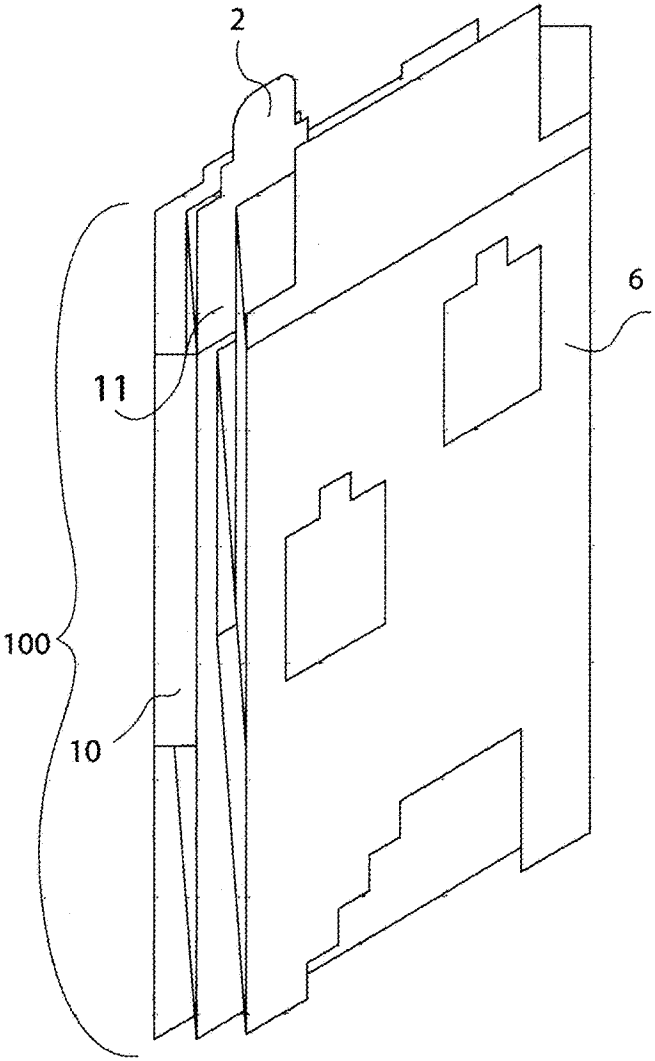
FIG. 1 is a perspective view of an embodiment of folding play structure in a closed storage position.

Although several embodiments, examples, and illustrations are disclosed below, it will be understood by those of ordinary skill in the art that the invention described herein extends beyond the specifically disclosed embodiments, examples, and illustrations and includes other uses of the invention and obvious modifications and equivalents thereof. Embodiments of the invention are described with reference to the accompanying figures, wherein like numerals refer to like elements throughout. The terminology used in the description presented herein is not intended to be interpreted in any limited or restrictive manner simply because it is being used in conjunction with a detailed description of certain specific embodiments of the invention. In addition, embodiments of the invention can comprise several novel features and no single feature is solely responsible for its desirable attributes or is essential to practicing the inventions herein described. Further, it should be understood that any of the examples herein are non-limiting. As such, the inventions disclosed herein are not limited to any particular embodiments, aspects, concepts, structures, functionalities, or examples described herein.

Children all over the world engage in imaginative play using scale models of people, cars, animals and other play figures. To facilitate the play process, various types of three dimensional structures have been designed and sold, such as doll houses and other scaled down environments such as auto garages, kitchens, and fire houses. Traditional play structures tend to be rather bulky and are therefore difficult to store in a child's room or other location within a home. Additionally, the play structures can be relatively expensive, and also may lack a fine degree of realism.

The disclosure herein presents various embodiments of collapsible or folding play structures that have many benefits over traditional play structures. For example, in some embodiments, a collapsible or folding play structure is disclosed that comprises at least two configurations, namely, a collapsed configuration and an open configuration. In the open configuration, the play structure presents a three dimensional play structure for children to use in playing with their toys, such as action figures, dolls, toy cars, and/or the like. In the collapsed configuration, however, the play structure can be collapsed down to take up less space for storage and/or transport. For example, in some embodiments, the open configuration comprises a multitier three-dimensional structure having left, center, and right play structures interconnected together, and the collapsed configuration comprises a substantially rectangular shape having a relatively small thickness. For example, in some embodiments, the collapsed configuration comprises outer envelope dimensions of approximately 33" (h)×15" (w)×4" (d), which is a size that can be easily stored in a closet, stored under a bed, and/or transported in a vehicle.

With a play structure that is intended to be portable, the weight of the structure can also be a concern. For example, a typical play structure, such as a dollhouse or similar, is built of relatively robust wood, plastic, and/or the like, and can be relatively heavy. Various embodiments disclosed herein, however, can comprise relatively lightweight materials, such as corrugated cardboard to form the various panels and/or components of the structure. In some embodiments, such a portable folding play structure can comprise a weight of approximately 4 pounds, which is easily transportable.

Further, in addition to the weight benefits, embodiments disclosed herein can be made of environmentally friendly materials, such as corrugated cardboard. This can be quite beneficial, particularly with a children's toy, since children inevitably grow up and eventually lose interest in their toys. Children's toys often end up being disposed of in landfills. By creating a play structure out of environmentally friendly materials, such as materials that can biodegrade, there can be less impact on the environment when such toys are eventually disposed of.

One challenge in creating a lightweight portable folding play structure is that, desirably, the play structure when in the open configuration should be relatively rigid in design, similar in rigidity to a non-collapsible play structure. A play structure that is less rigid in the open position than a typical non-collapsible play structure may be less fun for a child to play with, may be harder for a child to play with, and/or may be perceived as a lower quality item than a traditional non-collapsible play structure. Various embodiments disclosed herein address this problem by including specific combinations of movable and/or connectable joints between components of the play structure that, when assembled in the open configuration, lead to a play structure having sufficient rigidity for effective play. In some embodiments, the various joints are designed such that, in the open configuration of the play structure, there are 0 degrees of freedom in the joint structure, leading to a theoretically rigid open design. Even though there may be some flexibility in the components of the play structure and play in joints due to manufacturing and/or assembly tolerances, such a design can still be sufficiently rigid to be just as enjoyable to play with as a traditional non-collapsible play structure.

Another challenge addressed by the embodiments disclosed herein is that lightweight environmentally friendly materials, such as corrugated cardboard, inherently have less bending rigidity than materials typically used for children's play structures, such as plastic or wood. Further, it can be desirable to have a plurality of openings in the various panels or structures of the children's play structure, such as to enable children to pass toys therethrough, to allow toys to fall through holes, and/or the like. Such openings, however, can further reduce the bending rigidity of a panel of material, such as corrugated cardboard. Various embodiments disclosed herein allow materials such as corrugated cardboard to be used in a children's play structure by, among other things, strategically positioning stiffening members, multi-layered panels, folded-over double-layer edges, and/or the like, in addition to the specific joint configurations mentioned above and described in more detail below.

It should be understood that, although various embodiments disclosed herein desirably comprise a plurality of corrugated cardboard panels to form the play structure, the concepts and techniques disclosed herein are not limited to use with corrugated cardboard. For example, various embodiments disclosed herein could use panels comprising wood, plastic, corrugated plastic, foam, metal, composite materials, and/or the like. Corrugated cardboard has various benefits over such materials, however, such as with respect to weight and environmental concerns. Another benefit of corrugated cardboard over plastic is that, in a traditional play structure that is made of plastic or other materials, if the play structure breaks (such as from a child falling on the play structure or similar) the play structure can be difficult or impossible to repair. In a play structure that comprises corrugated cardboard, however, it is more likely that such a situation (e.g., a child falling on the play structure or similar) will result in the structure folding, bending, collapsing in on itself, and/or the like, instead of breaking. The structure can then in many cases be folded, pushed, and/or repositioned back into its intended shape, for continued play. In some cases, such a situation may result in one or more folds, score lines, and/or the like remaining in one or more panels, although the play structure may still be sufficiently rigid for its intended use as a play structure.

In some embodiments, the portable folding play structure can be deployed in under ten seconds. In some embodiments, the portable folding play structure uses the natural forces of gravity to create a three-dimensional self-supporting play structure. In some embodiments, the portable folding play structure uses scored and cut corrugated cardboard to create a stable play structure. In some embodiments, the portable folding play structure can be printed in four (or more or less) colors to create a photo-realistic environment. In some embodiments, the portable folding play structure has folded edges so that no exposed corrugations are seen during play activities. In some embodiments, some exposed corrugations are able to be seen, but at least some of the edged comprise folded over flaps to hide at least 75% of the corrugated edges.

Various other features and benefits are described below, with reference to specific embodiments described below and/or illustrated in the accompanying figures.

Example Portable Folding Play Structure

FIGS. 1-6 illustrate an embodiment of a portable folding play structure 100. Referring now to FIG. 1, we see a perspective view of the play structure 100 in the closed position. Left panel 2, center panel 4, and right panel 6 are in the folded position and connected by vertical and integral hinge members 10, 12. The play structure 100 is preferably made of corrugated cardboard, but may also be made of other rigid and scored materials such as plastic corrugated material (or manufactured otherwise). The closed position of FIG. 1 shows that the invention is relatively compact when in the stored position.

Figure 2:
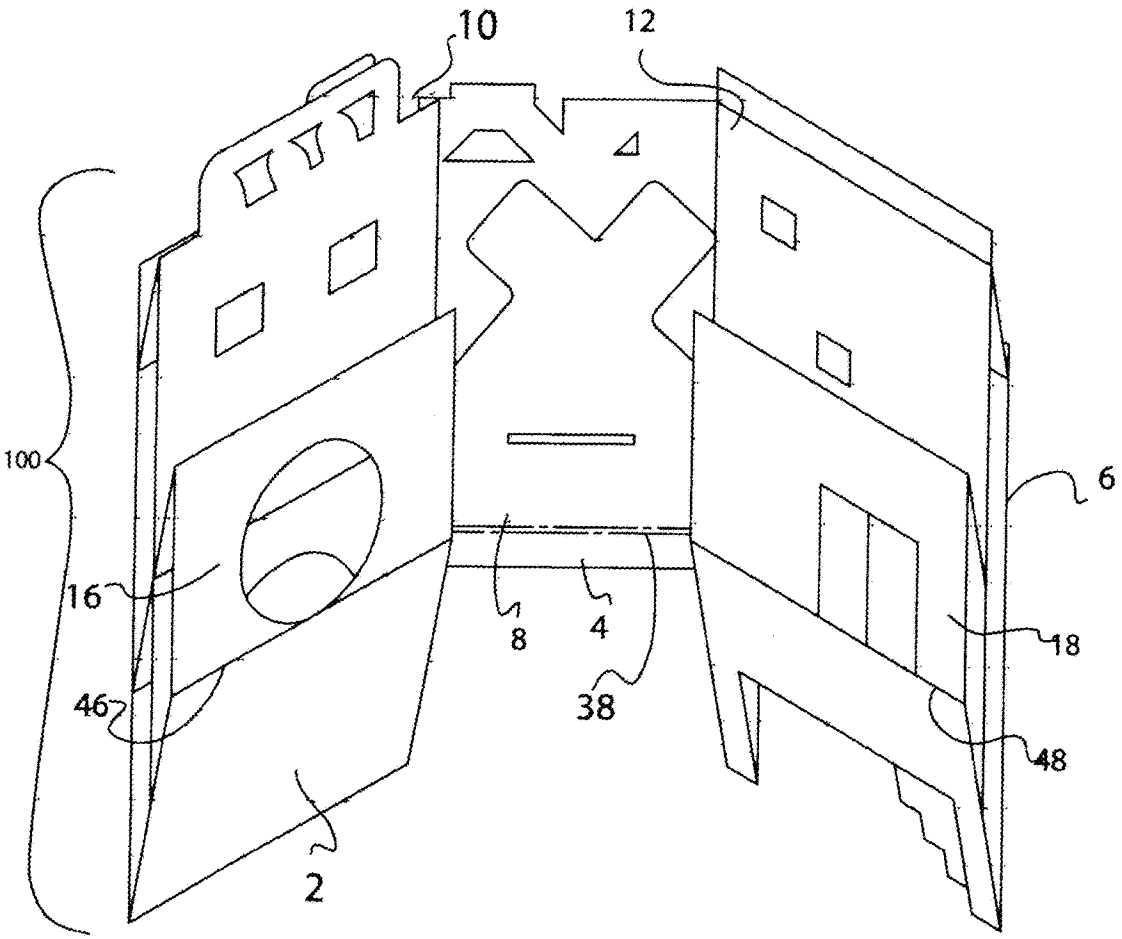
FIG. 2 is a perspective view of the embodiment of FIG. 1 in a partially opened position.
Figure 3:
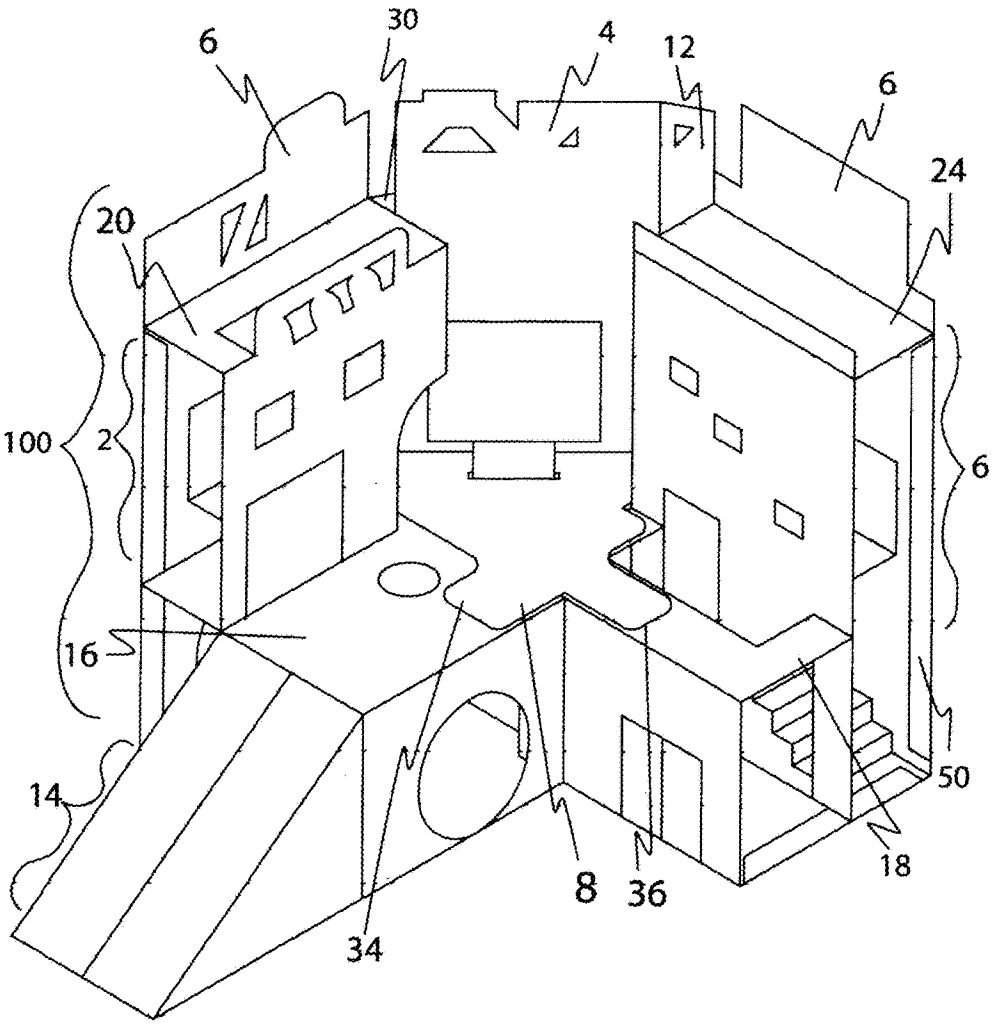
FIG. 3 is a perspective view of the embodiment of FIG. 1 in a fully open position.

FIG. 2 is a perspective view of the play structure 100 in the partially open position. Panels 2 and 6 include fold down members 16, 18 via scored hinge members 46, 48. The fold down members 46, 48 desirably automatically fall down to the use position as shown in FIG. 3 by the natural force of gravity. In some embodiments, the play structure can be made usable (e.g., transformed from the collapsed position of FIG. 1 to the open position of FIG. 3) in less than ten seconds.

FIG. 3 is a perspective view of the play structure in the use position. A right-angle relation is desirably formed between left panel 2 and right panel 6 causing the entire structure to be stable during play activity (although other embodiments may use an angle other than 90 degrees). The panels 2, 6 include tiered horizontal play surfaces 16, 18, 20, 24 that offer many imaginative play opportunities. Desirably, the surfaces of all corrugated panels are printed with color graphics that represent a photo-realistic environment that can be used in conjunction with other three-dimensional play figures, vehicles or other scaled down play items that a child may own. The X shaped member 8 (or connecting structure 8) is folded down and locked into horizontal surfaces 16, 18 to help make the entire structure 100 rigid. Many or all edges 50 comprise folded over and glued flaps so that a minimum of exposed corrugated edging is seen on the structure 100.

Figure 4:
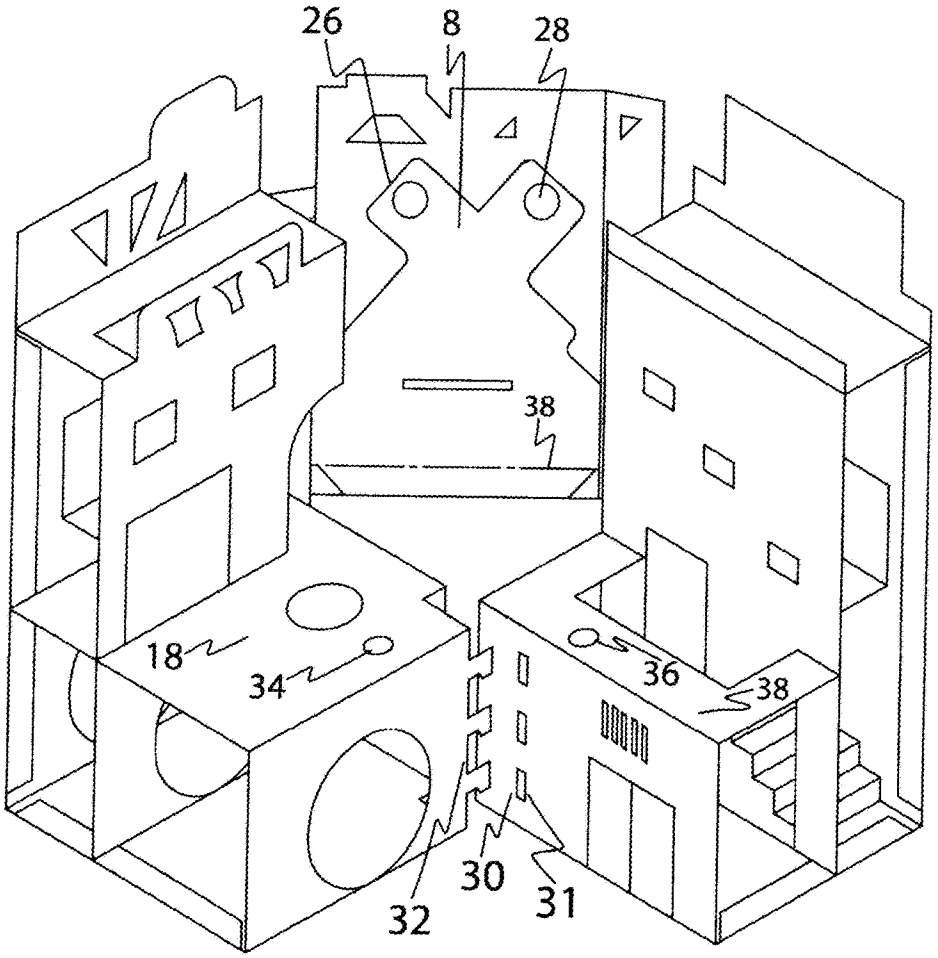
FIG. 4 is a partial perspective view of left and right connection members of the embodiment of FIG. 1 about to be connected.
Figure 5:
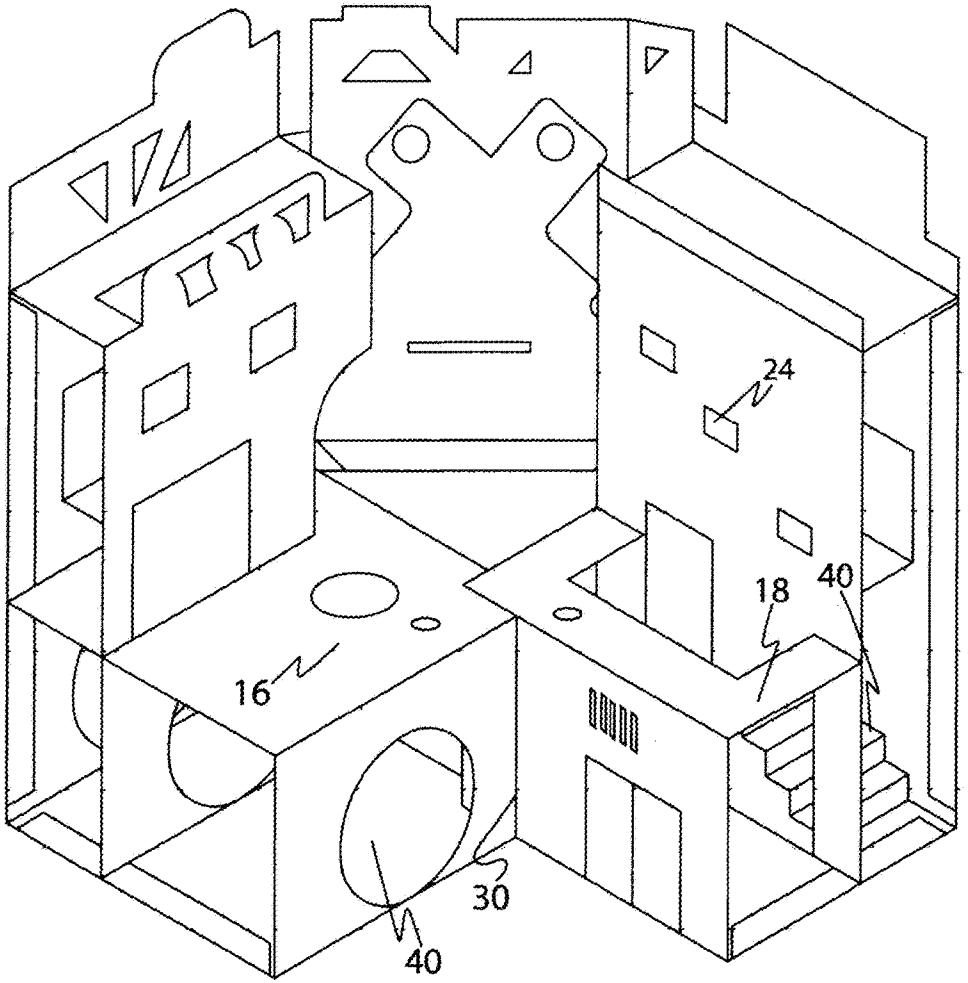
FIG. 5 is a partial perspective view of the left and right connection members of the embodiment of FIG. 1 connected.

FIG. 4 is a partial perspective view of the play structure 100 showing the two horizontal surfaces 16, 18 before they are joined together and before X shaped member 8 has been put in place. The edge of panel 34 at tabs 32 is ready to engage slots 30. When these two are attached, as shown in FIG. 5, the entire play structure 100 (or at a minimum the left and right panels 2, 6 and their fold out portions 16,18) is made rigid. X member 8 folds down via integral hinge member 38 and the ends 26, 28 of the X member 8 are folded ninety degrees and inserted into slots 34, 36 to further rigidize the structure 100 as shown.

FIG. 5 shows the many elements of the structure that are built in for play purposes, including stairs 40, tunnels 42 and windows 44. The structure can be used by children for imaginative play along with other scaled down figures or other items to facilitate hours of play. The graphic scenes printed onto the surfaces of the play structure 100 can vary from castles, to back alleys, to science fiction environments. The structure is ideally light weight and portable, making it an ideal toy to carry to a friend's house. The almost instant setup and compact takedown of the structure makes it ideal for use in small spaces such as a child's bedroom where it can be stored in a closet or under a bed when not in use. The use of the structure 100 can provide a richer experience when playing with toy figures that the child already owns.

Figure 6:
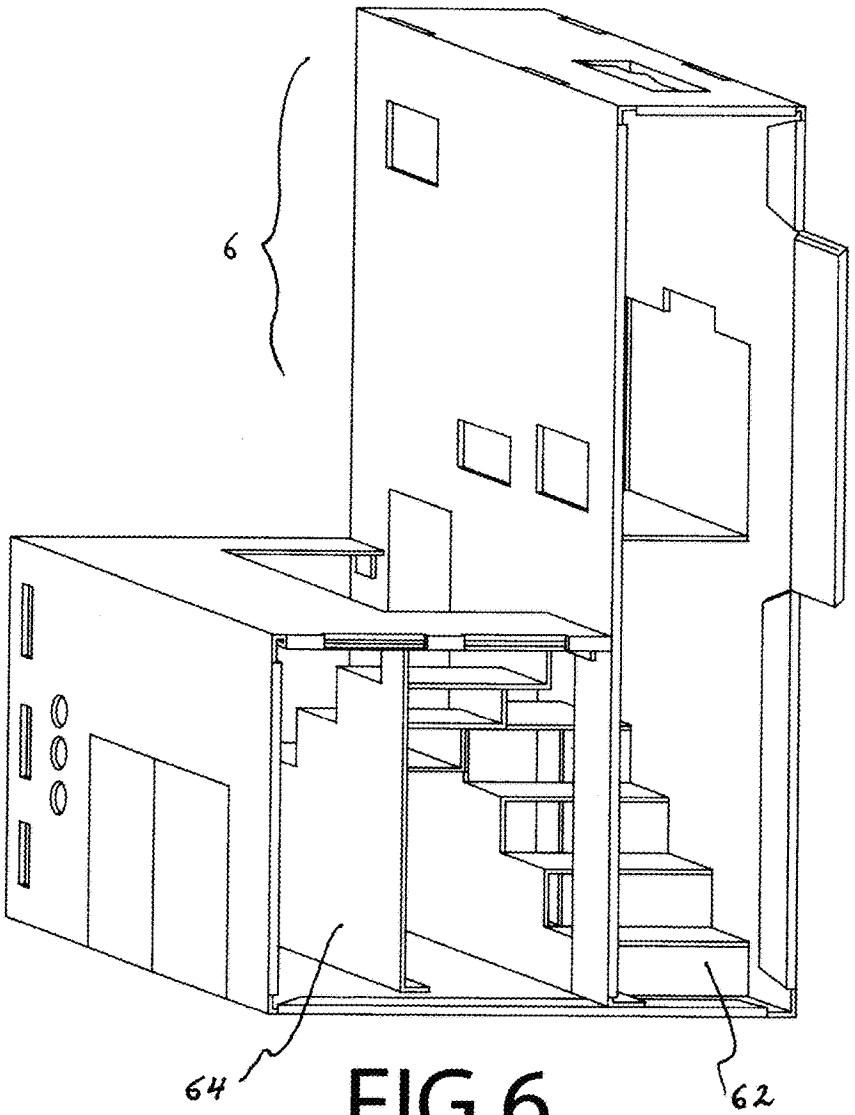
FIG. 6 is a partial perspective view of the embodiment of FIG. 1 showing an internal staircase.

FIG. 6 is a partial perspective view of the play structure 100 showing internal stairs 62, 64 that allow the user to transport play figures from one level to another, thereby adding more options to the play experience. These stairs 62, 64 also fold flat when the entire assembly 100 is folded for storage or transport. In addition to the play experience benefits, these stairs 62, 64, and other horizontal members of the structure, can help to add rigidity to the overall structure, and/or to increase the bending rigidity of adjacent vertically-oriented panels.

Additional Example Portable Folding Play Structure

Figure 7A:
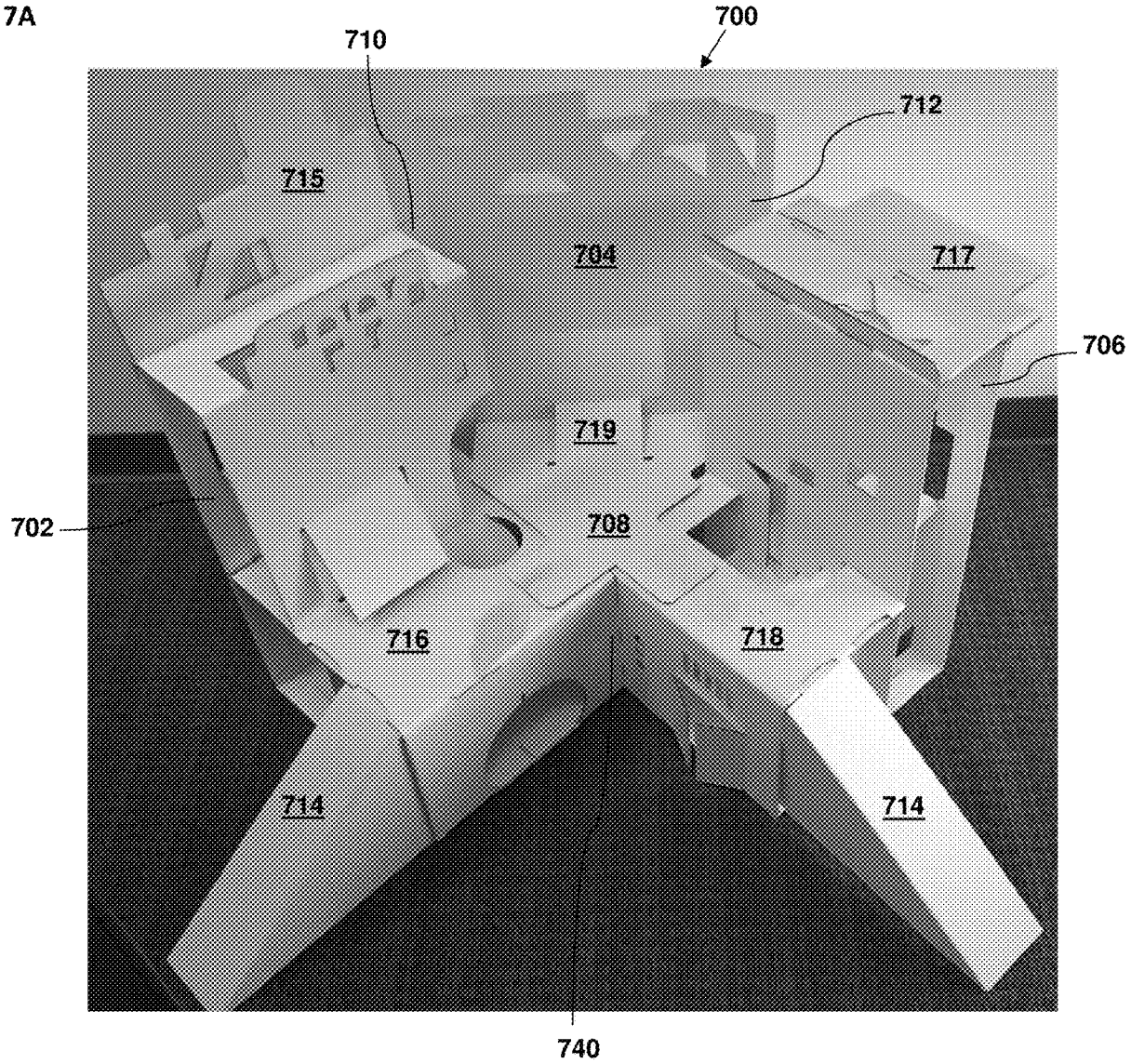
FIGS. 7A-7H illustrate another embodiment of a portable folding play structure, in varying stages of transition between collapsed and opened.

FIGS. 7A-7H illustrate another embodiment of a portable folding play structure 700 in various stages of assembly or configuration between the collapsed configuration (shown in FIGS. 7B and 7C), and the final assembled or open configuration (shown in FIG. 7A). The portable folding play structure 700 is similar in design to the portable folding play structure 100 illustrated in FIGS. 1-6 and described above, although some different or additional features are described below and shown in the figures.

FIG. 7A illustrates the open configuration, or final assembled configuration, of the portable folding play structure 700. The play structure 700 comprises a left panel 702, center panel 704, and right panel 706. These panels 702, 704, 706 desirably comprise one or more layers of corrugated cardboard or similar material. The left panel 702 is hingedly connected to the center panel 704 by a left hinge panel 710. The right panel 706 is hingedly connected to the center panel 704 by right hinge panel 712. Further, the left panel 702 comprises a left foldout structure 716, and the right panel 706 comprises a right foldout structure 718. The left and right foldout structures 716, 718 are shown connected together at releasable joint 740. Further, the center panel 704 is shown connected to the left and right foldout structures 716, 718 via a connecting panel or structure 708 that is hingedly coupled to the center panel 704 and drops down to engage the left and right foldout structures 716, 718. The connecting structure 708 is described sometimes herein as an X-shaped member, although various connecting structure 708 may be used that are not necessarily X-shaped. The open or assembled play structure 700 as illustrated in FIG. 7A results in an assembled structure that is sufficiently rigid to facilitate children playing with the play structure.

The hinge panels 710, 712 each have a width, with the width of the left hinge panel 710 being smaller than the width of the right hinge panel 712. This is desirable to enable the play structure 700 to be folded into a substantially flat rectangular configuration in the collapsed configuration, as illustrated in FIGS. 7B and 7C. With reference to FIGS. 7B and 7C, it can be seen that the right hinge panel 712 is wider because the left panel 702 is folded in toward the center panel 704 first in the collapsed configuration, and the right panel 706 is then folded on top of the left panel 702.

Left and right hinge panels 710, 712 facilitate the play structure being collapsed into a substantially flat configuration in the collapsed configuration (e.g., the left panel 702, center panel 704, and right panel 706 are capable of being simultaneously parallel to one another in the collapsed configuration). Since these hinge panels connect to the center and left or right panels via parallel hinge axes that are separated by a distance, however, such a structure can introduce additional degrees of freedom in the play structure than if the center panel were directly hingedly coupled to the left panel 702 and right panel 706. As further discussed below with reference to FIG. 8, various components of the design, such as the connecting structure 708, account for this additional degree of freedom to still result in an ideally rigid structure in the open configuration.

Wherever the terms horizontal and vertical are used herein, such as with respect to a horizontal axis or a vertical axis, these terms are in reference to the positioning of the play structure in its open configuration when resting on a flat ground surface. For example, a horizontal axis of the left, right, or center panels would be oriented parallel to the flat ground surface when the play structure is assembled as shown in FIG. 7A. A vertical axis of the left, right, or center panels would be oriented perpendicular to the flat ground surface when the play structure is assembled as shown in FIG. 7A.

FIG. 7A further illustrates a plurality of optional components that may in some embodiments be detachable and/or permanently attached to the play structure 700 (or in some embodiments may not even be included). For example, the play structure comprises two ramps 714, with one ramp shown coupled to the left foldout structure 716 and the other ramp 714 shown coupled to the right foldout structure 718. Desirably, the ramps 714 can be connected in various arrangements and can even be connected next to each other to create a wider ramp, such as is shown in FIG. 3. The play structure in FIG. 7A further comprises another ramp 719 that, in this embodiment, is hingedly attached to the center panel 704, and protrudes through a slot in the connecting structure 708. With such an arrangement, the ramp 719 can be caused to automatically rotate upward into a storage position when the connecting structure 708 is rotated upward, and to be automatically deployed into the position illustrated in FIG. 7A when the connecting structure 708 is dropped into the position in which it is shown in FIG. 7A. FIG. 7E illustrates the connecting structure 708 and ramp 719 in the storage position after the connecting structure 708 has been rotated upward. Various other components of a play structure in some embodiments may be automatically caused to deploy or collapse in response to another component moving, similarly to how the ramp 719 is automatically caused to move when the connecting structure 708 is folded upward or downward.

The portable folding play structure 700 also optionally comprises a left removable feature 715 and right removable feature 717. These removable features 715, 717 can desirably be formed by a flat sheet of corrugated cardboard that has been folded in half to provide additional structural rigidity. In some embodiments, one or more of the removal features 715, 717 can have multiple selectable configurations. For example, in the play structure 700, as further described below, the right removable future 717 can have two configurations, with one configuration being the horizontal configuration illustrated in FIG. 7A, and a second configuration being a vertical configuration, as illustrated in FIG. 10F.

Additional features of the portable folding play structure 700 are described elsewhere in this disclosure with reference to additional figures. As one example, any one or more of the features 714, 715, 717, 719 can be secured to any other feature or surface of the play structure using any attachment mechanism described herein, including but not limited to a latch, hook and loop fastener, magnet, string, band, clip, tab, slot, etc.

Assembly/Opening Sequence

FIGS. 7B-7H illustrate a sequence of actions to convert the portable folding play structure 700 from the collapsed configuration to the open or assembled configuration. FIGS. 7B and 7C illustrate opposite side views of the play structure 700 in the collapsed configuration. In this configuration, a back surface of the center panel 704 forms one outer surface of the assembly, and a back surface of the right panel 706 forms an opposite outer surface of the assembly, with the center panel 704 and right panel 706 being in a substantially parallel orientation. The left panel 702 is sandwiched between the center panel 704 and right panel 706, also in a substantially parallel orientation to those other panels.

Figure 7D:
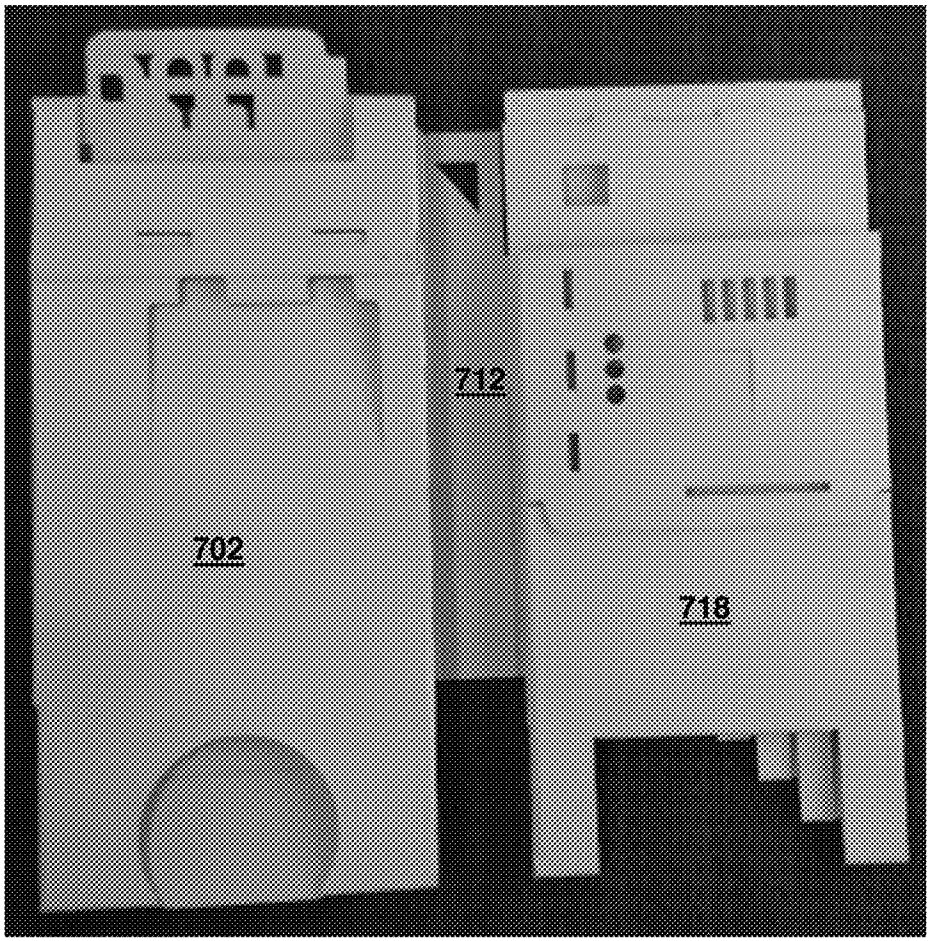
Figure 7C:
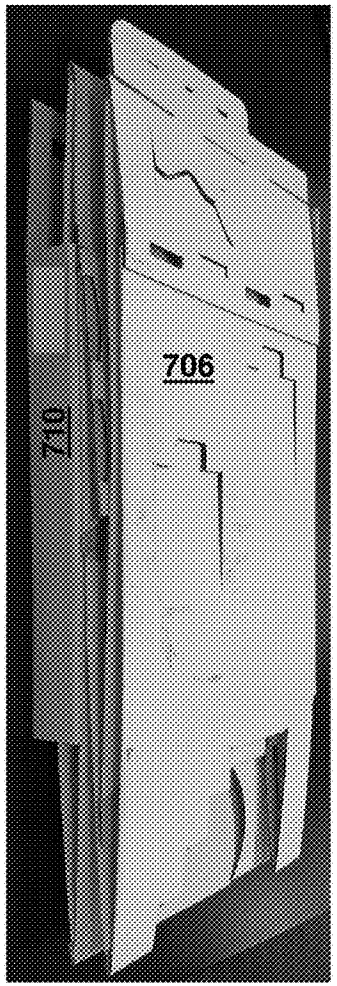
Figure 7B:
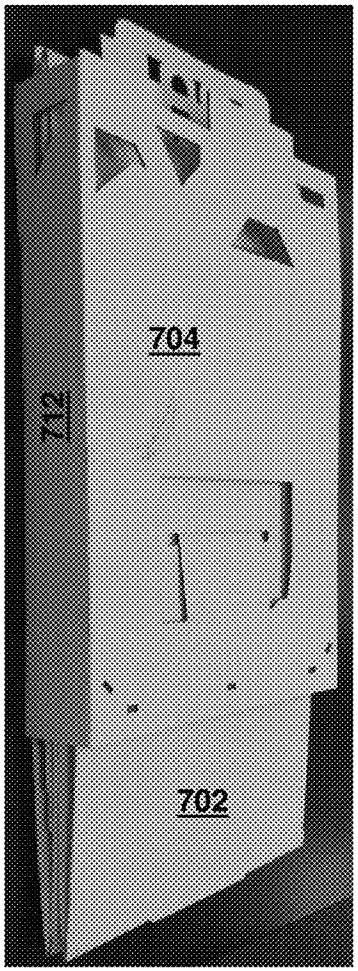
Figure 7E:
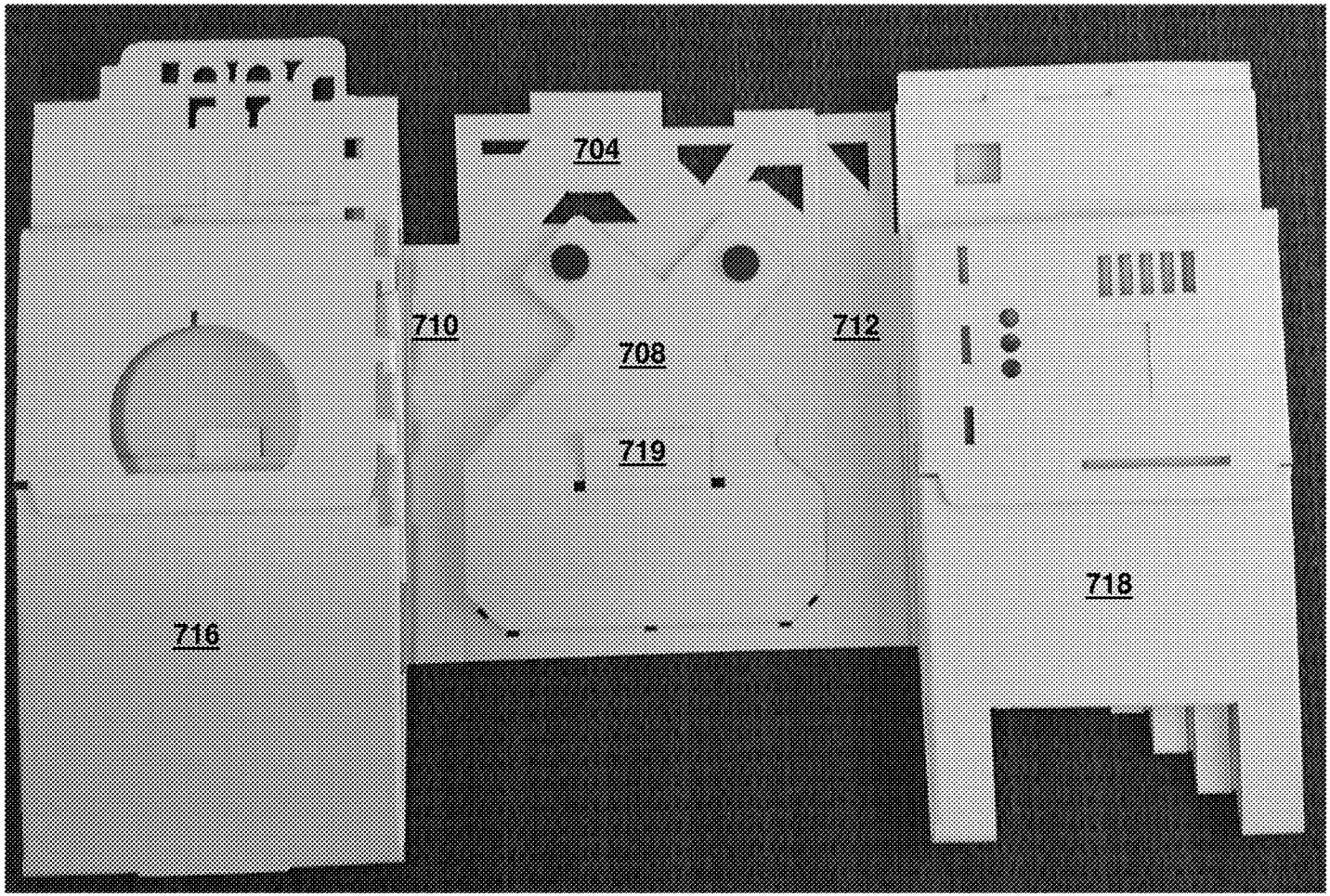

FIG. 7D illustrates a first step in converting the play structure 700 from the collapsed configuration to the open configuration. In this step, the right panel 706 has been folded outward and rotated approximately 180° from the orientation illustrated in FIG. 7C. FIG. 7E illustrates a second step in converting the play structure 700 from the collapsed configuration to the open configuration. In this step, the left panel 702 has been folded outward and rotated approximately 180° from the orientation illustrated in FIG. 7D. Accordingly, in this stage, the left, center, and right panels 702, 704, 706 are lying flat on the ground surface. The left and right panels 702, 706 are not called out in FIG.

7E, however, because they are hidden by the left and right foldout structures 716, 718 in this view.

Figure 7F:
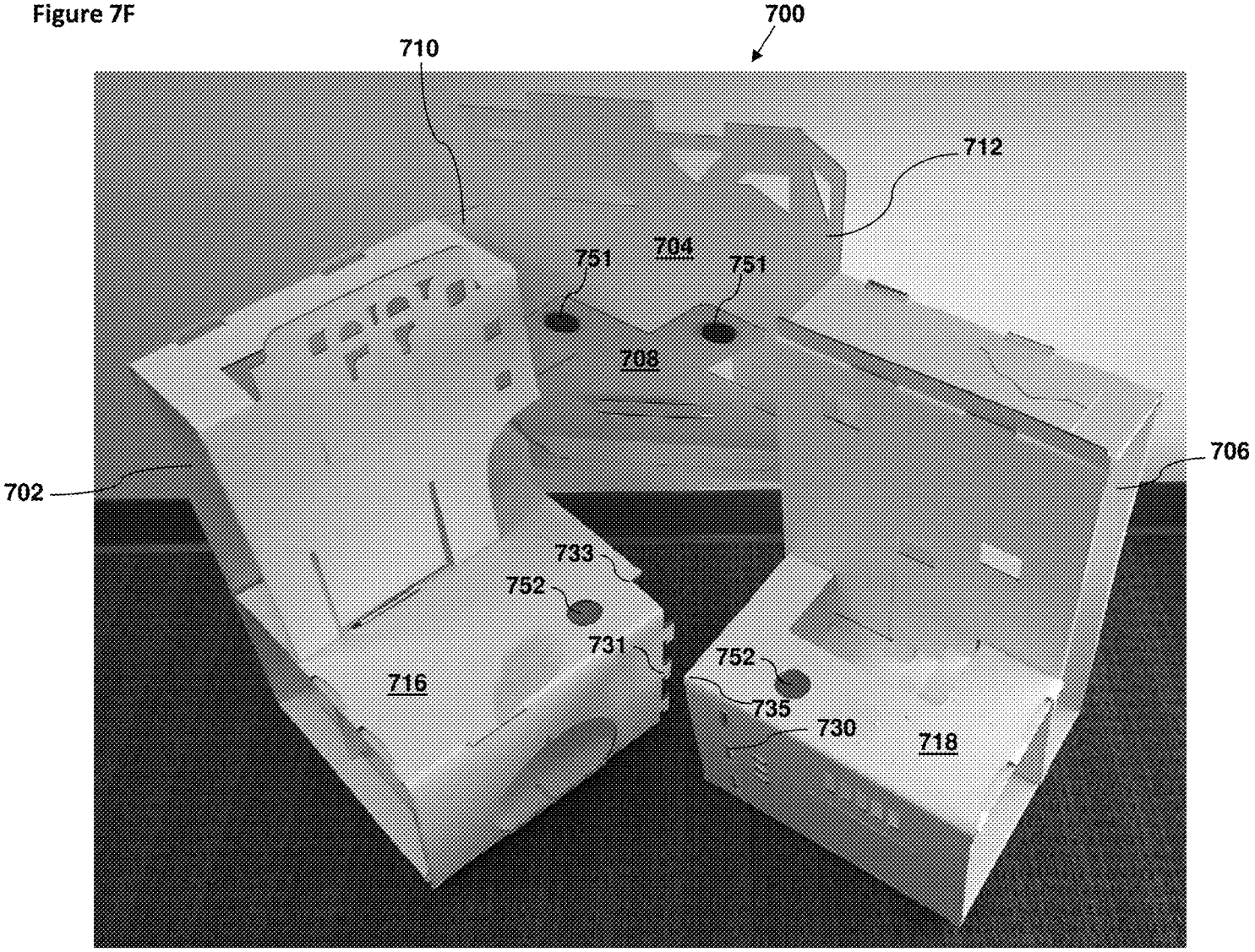
Figure 7G:
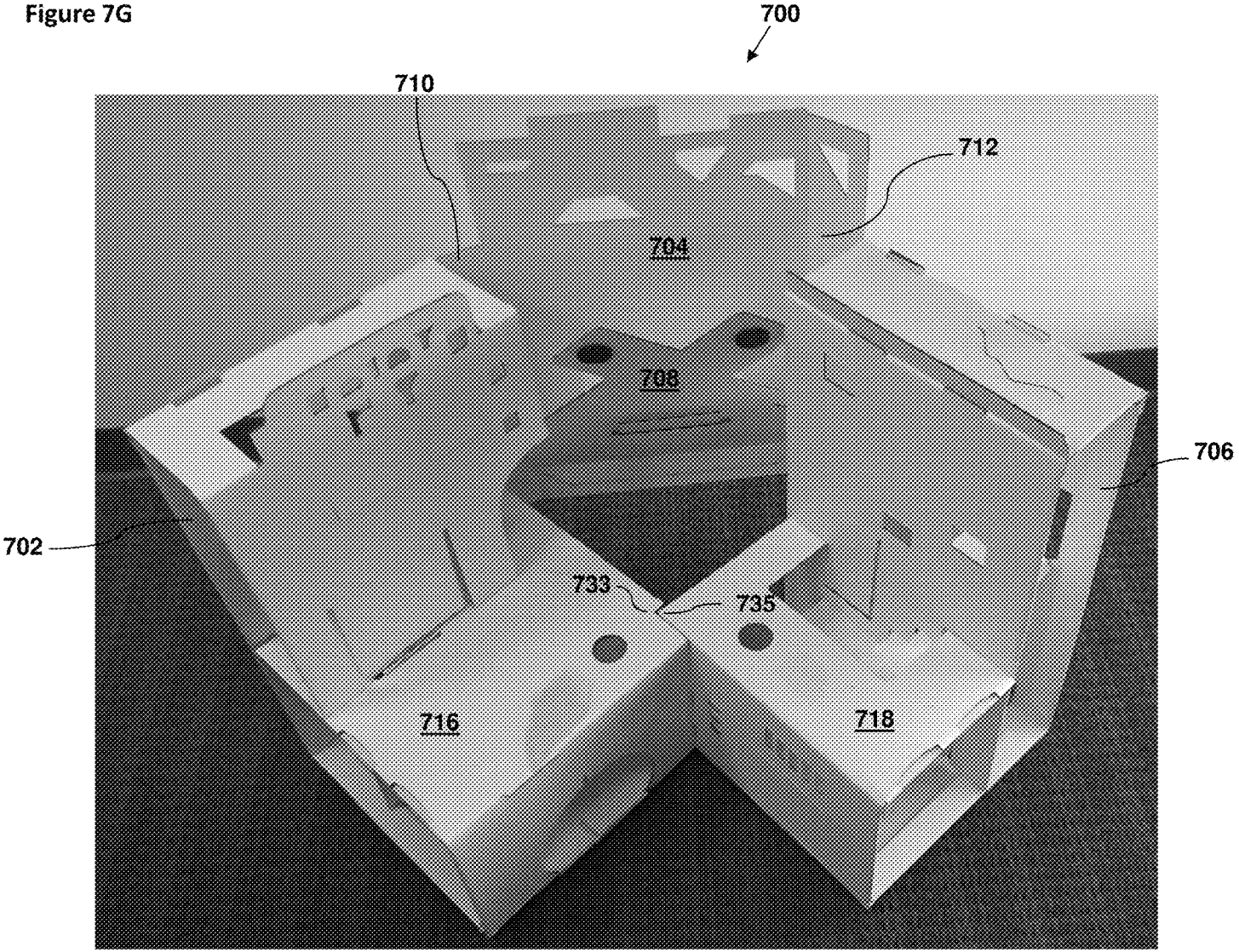
Figure 7H:
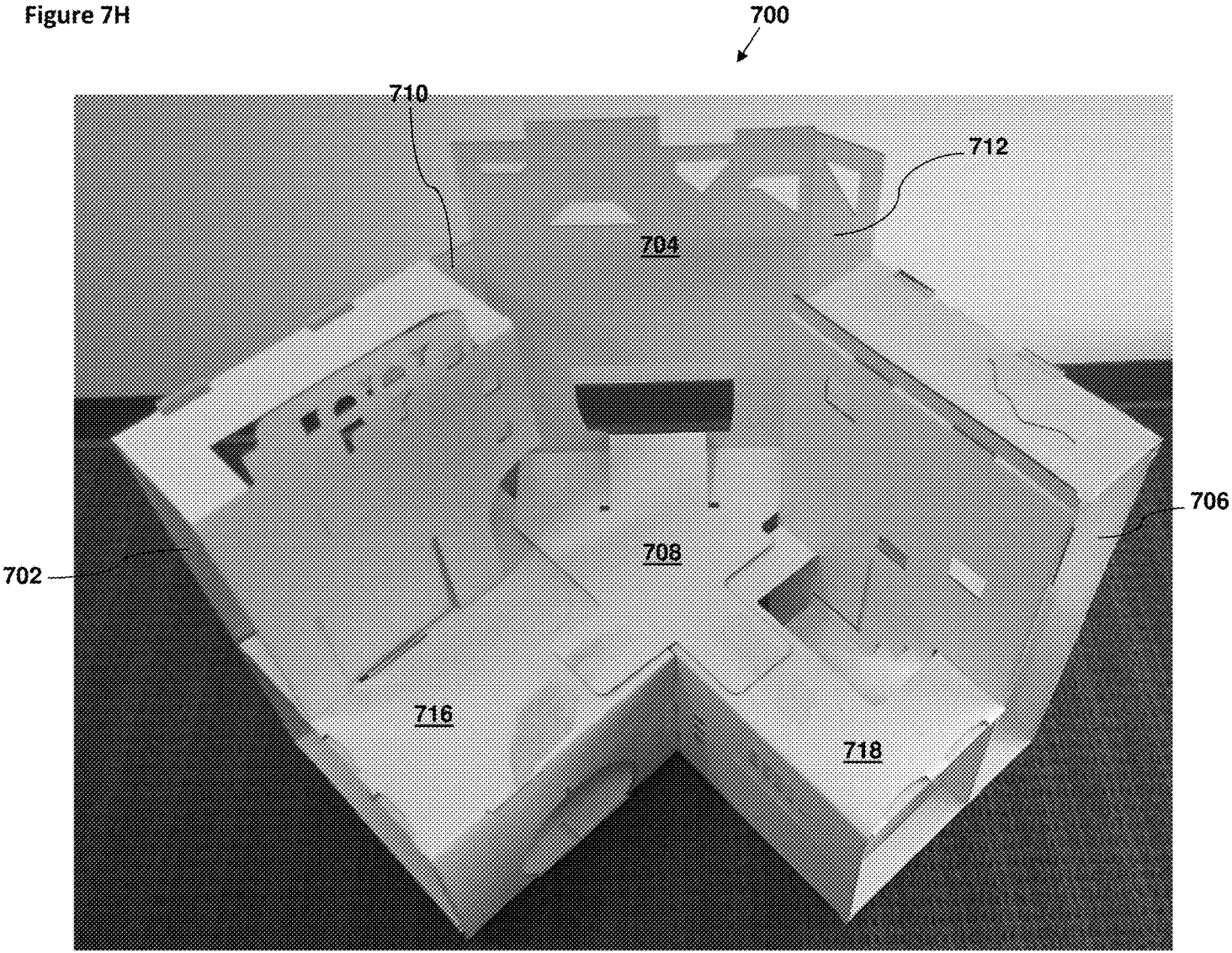

FIG. 7F illustrates a third step in converting the play structure 700 from the collapsed configuration to the open configuration. In this step, the play structure 700 is tilted upward off of the ground surface, and the left and right foldout structures 716, 718 are folded outward from the left and right panels 702, 706. FIG. 7G illustrates a fourth step in converting the play structure 700 from the collapsed configuration to the open configuration. In this step, the left foldout structure 716 is connected to the right foldout structure 718. FIG. 7H illustrates a fifth step in converting the play structure 700 from the collapsed configuration to the open configuration. In this step, the connecting structure 708 is rotated downward and connected to the left and right fold-down structures 716, 718. This completes the conversion of the main structure of the play structure 700 from the collapsed configuration to the open configuration. However, as discussed above, various optional components may be added to the structure as shown in FIG. 7A, such as the ramps 714, left removable feature 715, and/or right removable feature 717.

Although the above description is given as a sequence of steps, this is not intended to imply that conversion of the play structure from the collapsed configuration to the open configuration can only be performed by performing this specific set of steps in this order. Some steps may be combined into a single step, additional steps may be added, and/or some steps may be performed before others.

Play Structure Rigidity

As mentioned above, one benefit of the embodiments of collapsible or foldable play structures disclosed herein is that they can comprise a plurality of movable and/or separable joints to facilitate the collapsing or folding, but can also form a substantially rigid structure when assembled in the open position. This can be beneficial, for example, because the play structure can act more like a traditional play structure with respect to its rigidity when the play structure is in its open configuration.

Figure 8:
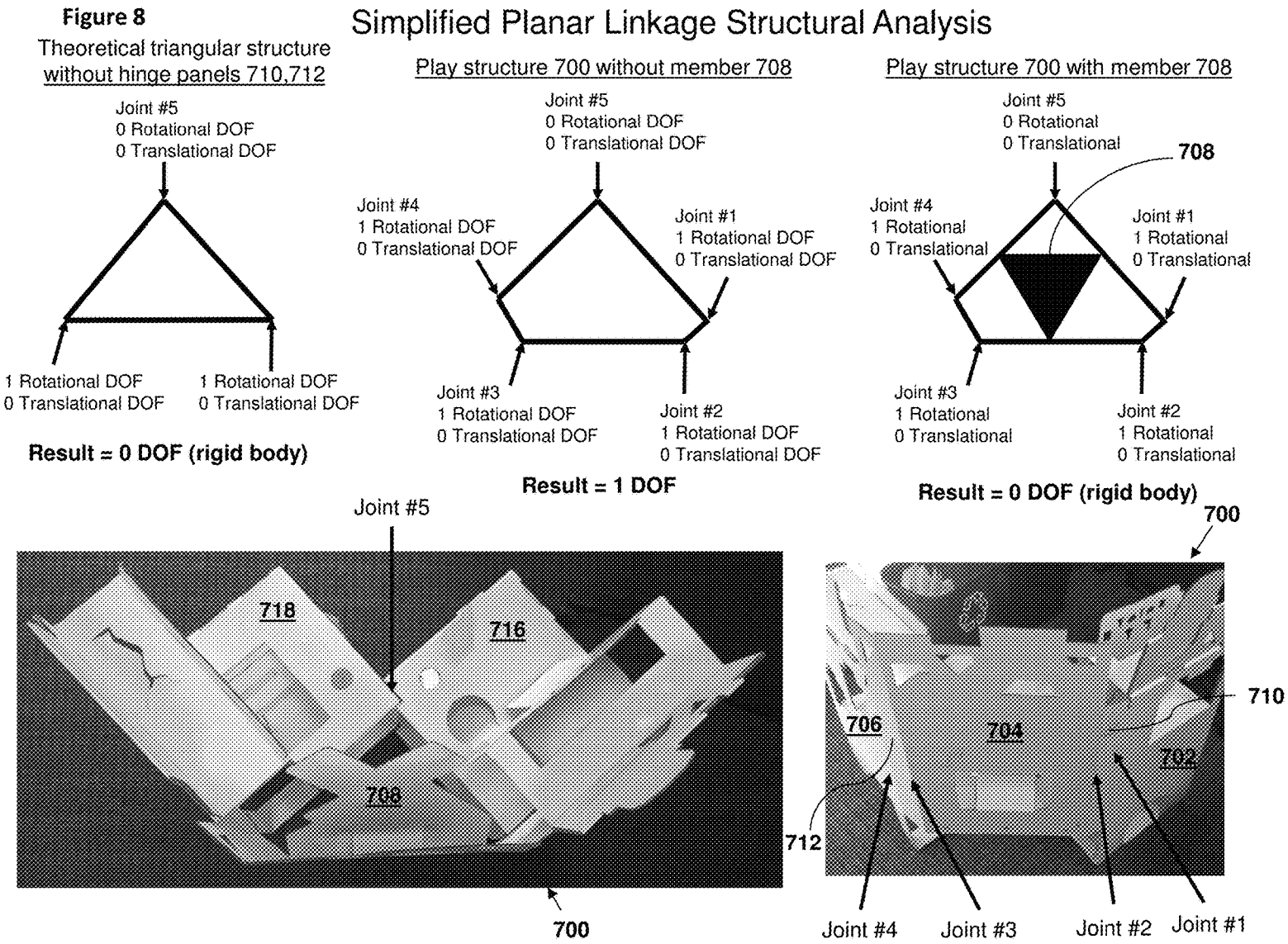
FIG. 8 illustrates a joint structure of the embodiment of FIG. 7A.

FIG. 8 illustrates an example of a planar linkage analysis that illustrates the rigidity of the example embodiment of the foldable play structure 700 of FIG. 7A. The play structure 700 is analyzed with respect to its rigidity in a plane defined by a flat surface that the play structure rests on in the open position (e.g., a flat ground or floor surface). The images at the bottom of FIG. 8 illustrates the various components and joints on the play structure 700, and the diagrams at the top of FIG. 8 illustrate simplified diagrams of rigid bodies connected by joints for the planar linkage analysis. The middle diagram illustrates a simplified diagram of the play structure 700 without the connecting structure 708. The right diagram illustrates a similar simplified diagram, but with the connecting structure 708 included. The left diagram illustrates a theoretical triangular structure without the hinge plates 710 and 712, for comparison to the other diagrams.

Each of the three diagrams in FIG. 8 depicts a number of rigid bodies and the number of rotational and translational degrees of freedom at each joint between the rigid bodies. Each of these three diagrams was analyzed using Gruebler's equation (shown below), to determine the resulting number of degrees of freedom of the assembled structure, with the number zero meaning the structure is theoretically a rigid structure with no degrees of freedom.

$$M=\text{degrees of freedom}=3(n-1)-2j_p-j_h$$

where, n=total number of links in the mechanism $j_p$=total number of primary joints (e.g., 1 DOF joints)

$j_h$=total number of higher-order joints

With respect to the first diagram, which is a theoretical triangle created by the center panel 704 being directly hingedly coupled to the left and right panels 702, 706, applying the planar linkage formula to this structure result in 0° of freedom, meaning a theoretically rigid structure.

As discussed above, however, it can be beneficial to include the hinge panels 710 and 712 on either side of the center panel 704, to enable the play structure to more easily and more neatly folded into a substantially flat package in the closed or collapsed configuration. Once these hinge panels 710, 712 are added, however, as shown in the middle diagram of FIG. 8, one degree of freedom of motion is introduced into the assembled structure. Specifically, the center panel 704, left hinge panels 710, and right hinge panels 712 may have at least some freedom of motion with respect to the left and right panels 702, 706 and their foldout structures 716, 718. In some embodiments, this additional degree of freedom of motion may be acceptable. For example, the left and right panels 702, 706 and their foldout structures 716, 718 are still rigidly connected together, and the freedom of movement in the center panel 704 may be relatively small in some designs. However, by adding an additional structural link between the left and/or right end panel (or their fold out portions 716, 718) and one or more of the center panel 704, left hinge panels 710, or right hinge panel 712, this additional degree of freedom can be eliminated, resulting in a theoretically rigid structure. This is illustrated by the right-most diagram, which adds the connecting structure 708 into the analysis. The connecting structure 708 connects the center panel 704 to both of the foldout structures 716 and 718. This eliminates any degrees of freedom in the resulting planar linkage analysis, resulting in a theoretically rigid body. Accordingly, a design such as the foldable play structure 700 can collapsed down into a neatly compacted structure, by, among other things, addition of the hinge panels 710 and 712, but can still maintain the theoretical rigidity of a triangular structure depicted in the left diagram of FIG. 8, by adding the connecting structure 708.

It should be noted that the above planar linkage analysis assumes rigid bodies and that there is no play, slop, or flex in the various joints. In reality, no material is ever truly rigid, and joints will always have at least some flex, slop, or play. However, the above analysis shows that a structure such as the foldable play structure 700 can be a relatively rigid structure, with any flex or movement only being introduced by the inherent flexibility of the materials and/or any manufacturing and/or assembly tolerances associated with joints. Further, depending on the types of and number of separable joints used, the structure can theoretically become over constrained, which can in some embodiments compensate for at least some flex in the materials and/or tolerances in the joints.

Separable Joints

As discussed above, the portable folding play structure 700 desirably comprises a plurality of permanent joints, such as hinged joints created by folds at hinge panels 710 and 712, and one or more removable or separable joints, such as the joints that connect the foldout structures 716 and 718 together and that connects the connecting structure or X-shaped member 708 to the fold-down structures 716, 718. FIG. 4 and also FIG. 7F illustrate examples of the separable joints. For example, with reference to FIG. 7F, the left foldout structure 716 comprises three tabs 731 extending horizontally therefrom and configured to fit into three corresponding slots 730 of the right fold-down structure 718. These tabs 731 further comprise a protrusion protruding downward that is intended to lock the tabs 731 in place after being passed through the slots 730, to help keep the foldout structures 716, 718 connected together while children are playing with the structure. Although this embodiment illustrates three tabs 731 that fit into three slots 730, various other embodiments may connect the foldout structures 716, 718 in various other ways. For example, any other type of fastener that can fasten the foldout structures 716, 718 together can be used. Some examples include magnets, hook and loop fasteners, non-permanent adhesives, screws, nuts, bolts, latches, hooks, and/or the like. Although in this embodiment the tabs 731 and slots 730 are integral to the foldout structures 716, 718, other embodiments may have additional components or fasteners added to the foldout structures to facilitate fastening the foldout structures together.

An additional feature illustrated in FIG. 7F is that the foldout structure 716 comprises a recess 733 shaped and configured to abut the corner 735 of the foldout structure 718 when in the assembled position, as shown in FIG. 7G. By having the corner 735 abut the recess 733, this can help to provide additional rigidity to the structure, such as to at least partially account for assembly and/or manufacturing tolerances and/or flexibility of the tabs 731.

Another separable joint illustrated in FIG. 7F is the separable connection between the connecting structure 708 and the foldout structures 716, 718. Specifically, in this embodiment, the separable joints between the structures are formed by two magnets 751 positioned on the underside of connecting structure 708 (or alternatively embedded within or positioned on the topside) and two magnetic components 752, such as ferrous metal components, embedded in or positioned on or under a portion of the foldout structures 716, 718. When the connecting structure 708 is dropped down from its vertical storage position to its horizontal in use position, the magnets 751 desirably engage the magnetic material 752, thus linking the connecting structure 708 to the foldout structures 716 and 718. Although this embodiment utilizes magnets to connect the connecting structure 708 to the foldout structures 716 and 718, various other removable fasteners may be utilized to perform similar purposes. For example, other embodiments may use hook and loop fasteners, nonpermanent adhesives, screws, nuts, bolts, latches, hooks, and/or the like. Further, in some embodiments, the connecting structure 708 may comprise one or more tabs that fit into one or more slots of the foldout structures 716, 718, similar to the tabs and slots 731, 730 that connect together the foldout structures 716, 718. Further, although in this embodiment the connecting structure 708 connects to both of the foldout structures 716, 718, in other embodiments, the connecting structure may connect to only one of the foldout structures, and/or multiple connecting structures may be used, with one connected to the left foldout structure 716 and another connected to the right foldout structure 718. In some embodiments, the magnets 751 and the magnetic material 752 are of a sufficient size that they would tend to not be able to be swallowed by a child. This can help with the safety of the collapsible play structure, such as if the magnets 751 and/or magnetic material 752 were to become detached from the assembly. In some embodiments, the magnets and/or magnetic material are at least 2.5 inches in diameter.

Removable and/or Reconfigurable Components

As mentioned above, the portable folding play structure 700 can optionally include one or more removable and/or reconfigurable components, such as the ramps 714, left removable feature 715, and/or right removable feature 717. The following description provides additional details of such features, with reference to additional figures. It is important to note that, although such features can be optional and can be removable, in at least some embodiments, one or more or even all of such features can be permanently installed, and/or can be left in place when collapsing the assembly into the collapsed configuration. This can be desirable, for example, to simplify collapsing of the assembly and opening of the assembly. Further, it can be desirable for some (or most or even all) features of the assembly to fold into the collapsed position automatically when the assembly is closed or folded up.

Figure 9B:
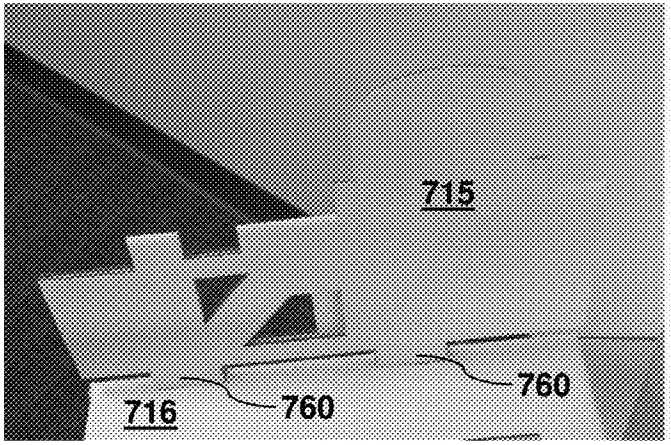
FIGS. 9A-9C illustrate an embodiment of a panel separable from the folding play structure of FIG. 7A.
Figure 9C:
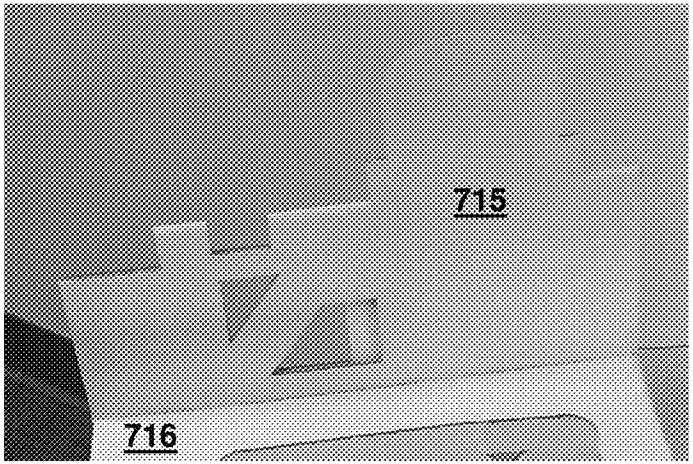
Figure 9A:
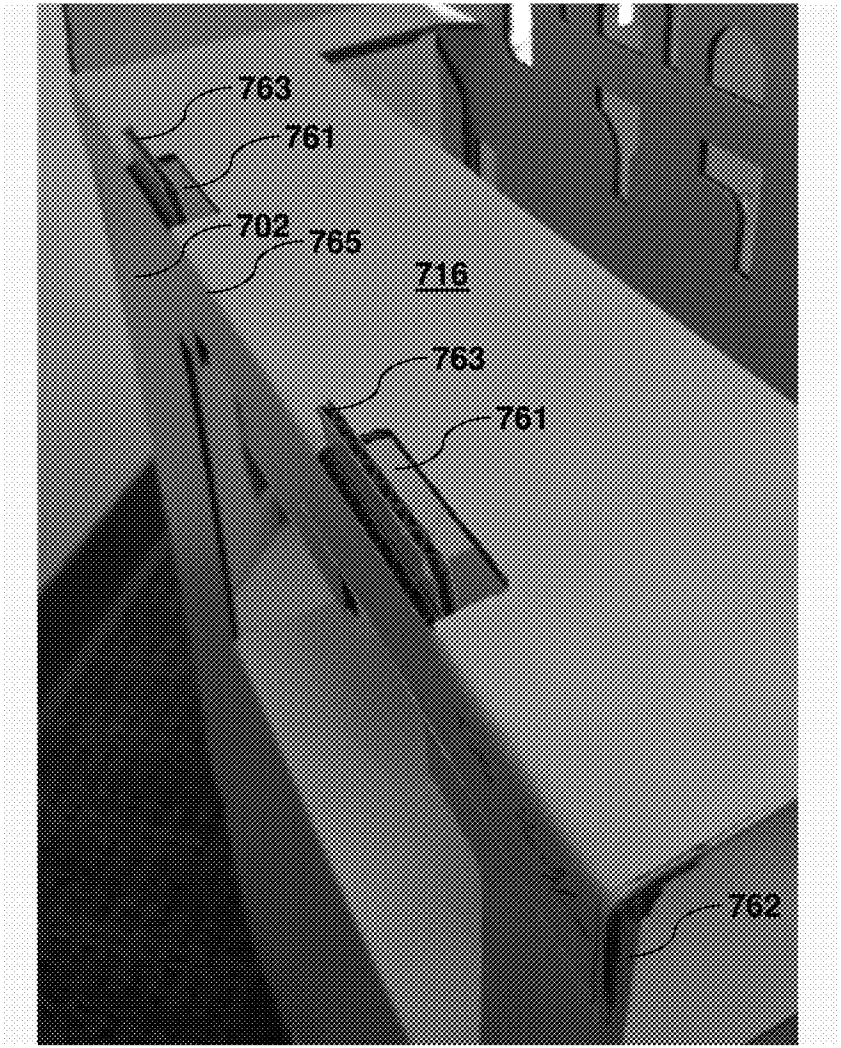

FIGS. 9A-9C provide additional detail related to the optional left removable feature 715. In this embodiment, the left removable feature 715 comprises a flat piece of corrugated cardboard (e.g., folded, folded in half, etc.). The left removable feature 715 comprises two tabs 760 which protrude downwardly therefrom and are sized to fit into mating slots 761 of the left foldout structure 716. In this embodiment, the slots 761 are formed adjacent to the hinged joint 765 that connects the foldout structure 716 to the left panel 702. In other embodiments, however, the slots 761 may be positioned elsewhere. The positioning of the slots 761 in this embodiment can be desirable, however, because they are strategically positioned to allow for a more stable retention of the left removable feature 715. Specifically, in this embodiment, the left foldout structure 716 is joined to the back panel 702 at a multilayer joint 762, which can be seen in the lower right of FIG. 9A. In this embodiment, a portion of the foldout structure 716 has been overlapped with the left panel 702 and adhered thereto, such as by using a permanent adhesive, one or more fasteners, and/or the like. By having the foldout structure 716 at least partially overlap the back panel 702, a more structurally rigid multilayer joint 762 is created than if the left panel 702 and foldout structure 716 were formed from a single piece of corrugated cardboard that were simply folded over at the hinged joint 765. Some embodiments may, however, use such a configuration without a multilayer joint 762.

Figure 11B:
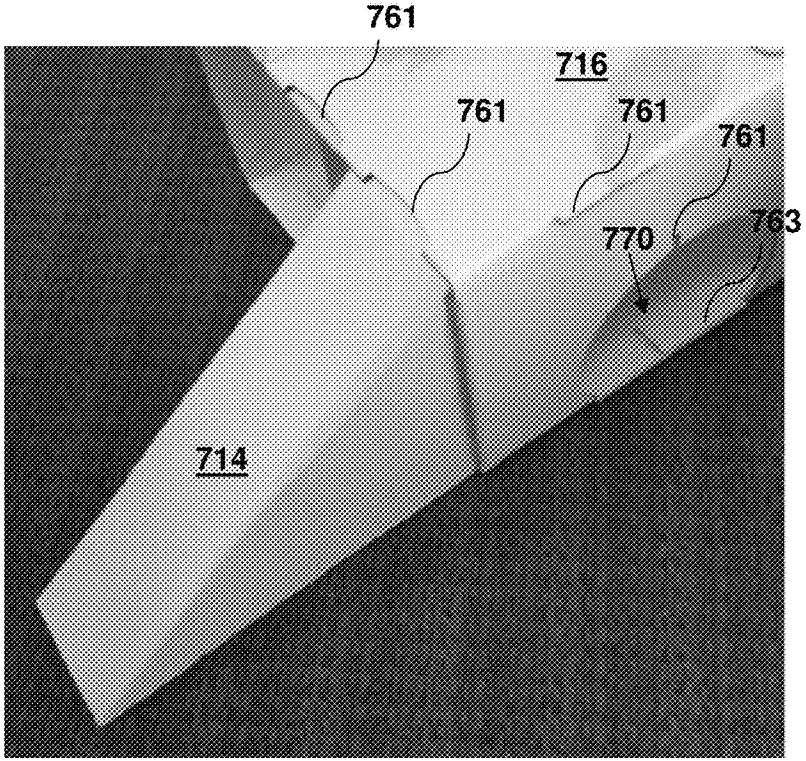
FIGS. 11A-11B illustrate an embodiment of a ramp separable from the play structure of FIG. 7A.

In addition to the rigidity benefits, the multilayer joint structure 762 enables integral tabs or protruding members 763 of the left panel 702 to protrude through and extend above a top surface of the left foldout structure 716 and/or slots 761. These protruding members 763 can act as a backing that engages a back surface of the left removable feature 715 and/or the tabs 760 of the left removable feature 715 when the left removable feature 715 is assembled to the play structure. This can increase the rigidity or stiffness of the left removable feature 715 with respect to the left panel 702 and/or left foldout structure 716. For example, with respect to the ability of the left removable feature 715 to rotate about an axis aligned parallel with the hinged joint 765 (e.g., a horizontal axis of the left panel 702), the left removable feature 715 will have less ability to rotate about that access when protruding members 763 are present as compared to a design without protruding members 763. Another advantage of protruding members 763 is that they can be used to align joint 762 prior to permanently affixing the joint 762 (such as using adhesive, fasteners, and/or the like). Similar concepts can be used in various other parts of the assembly, to aid in the manufacturing process of the play structure, so that any joints that need to be fastened during the manufacturing process (using adhesive, fasteners, and/or the like) can be accurately aligned, resulting in a properly aligned final assembly. For example, one or more tabs or protruding members 763 can also be used to align glued (or otherwise permanently assembled) joints at a bottom edge of the foldout structures 716, 718. For example, FIG. 11B illustrates a protruding member or tab 763 extending into opening 770 to help in aligning the assembly during manufacturing. As another example, FIGS. 12H and 12I illustrate a protruding member or tab 763 extending into opening 770 to help in aligning the assembly during manufacturing. These features can be desirable because, among other things, they can aid in assembling an accurately aligned collapsible play structure, without requiring (or at least reducing the need for) specialized assembly tooling. If the assembly were not accurately aligned during manufacturing, this could result in a play structure that is crooked or otherwise does not fold out correctly when a user opens it. In addition to the aesthetic and potential rigidity issues, if a user then tried to force the structure into a proper alignment, it could cause bulges, weakened areas, double scores, and even tearing. Accordingly, alignment tabs such as protruding members 763 can be beneficial.

Figure 10A:
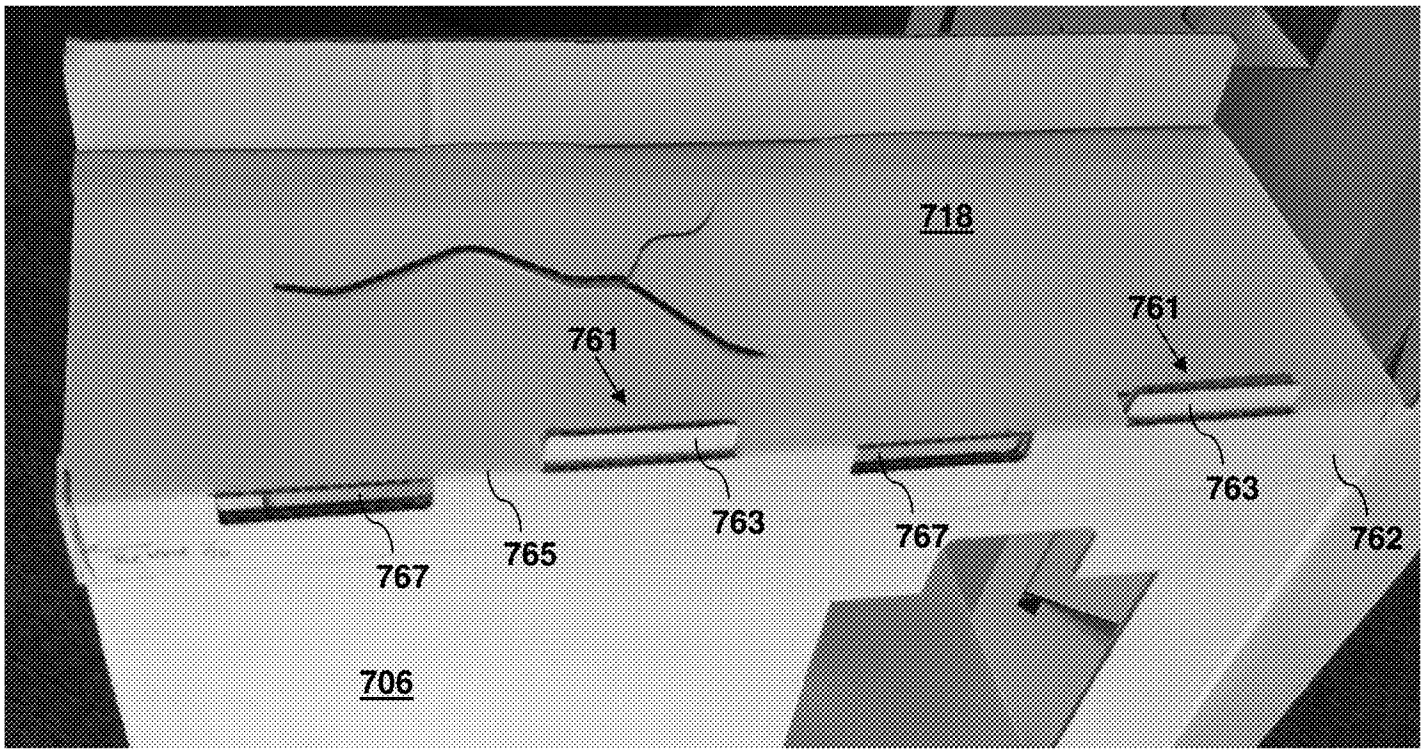
FIGS. 10A-10J illustrate an embodiment of a reversible panel separable from the folding play structure of FIG. 7A.
Figure 10B:
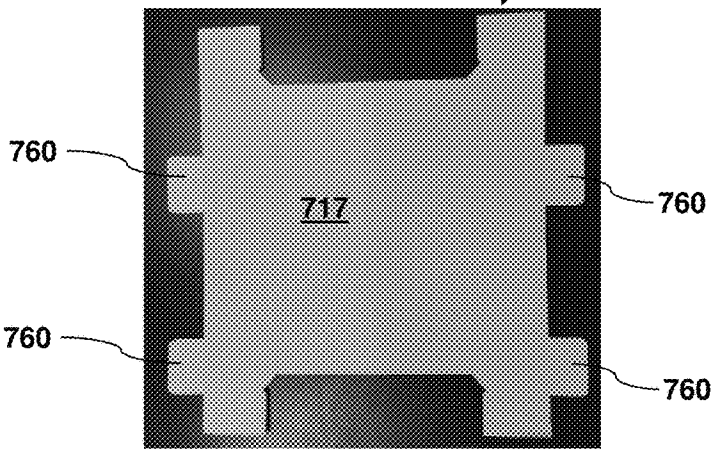
Figure 10D:
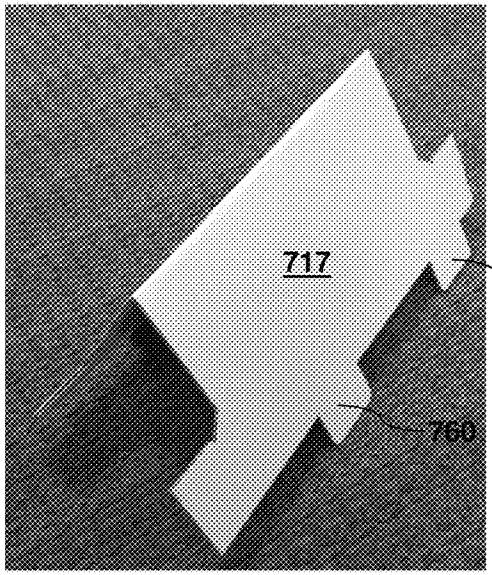
Figure 10C:
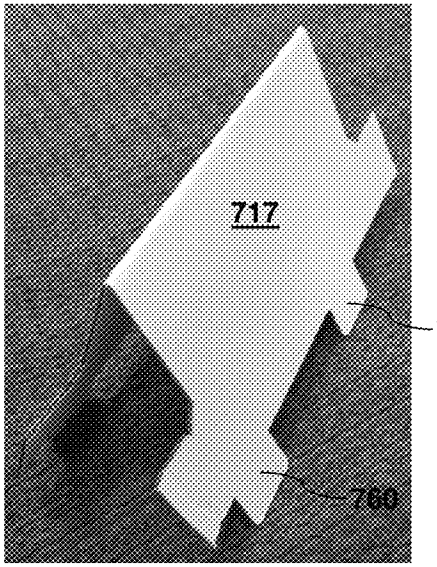
Figure 10F:
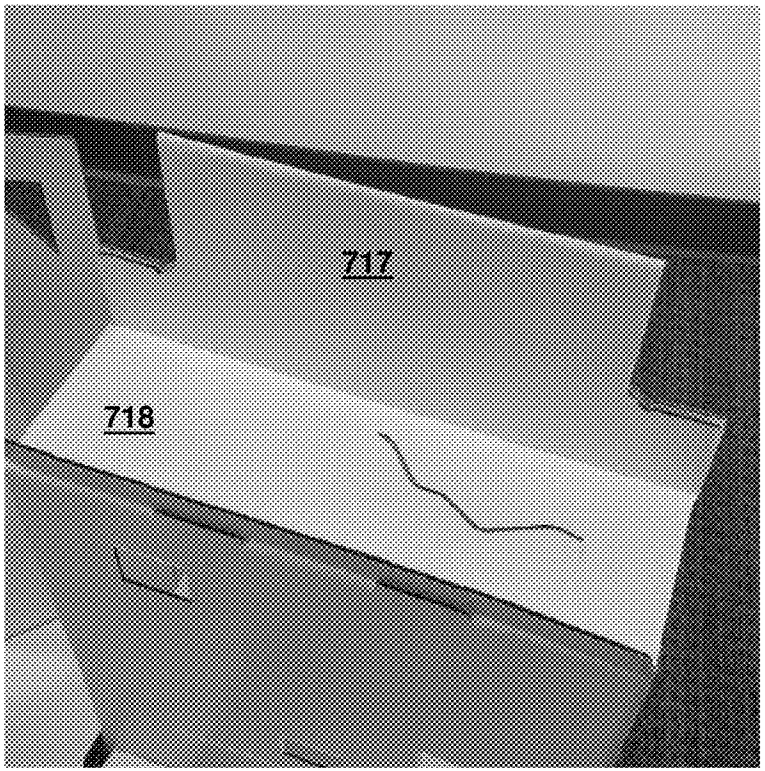
Figure 10E:
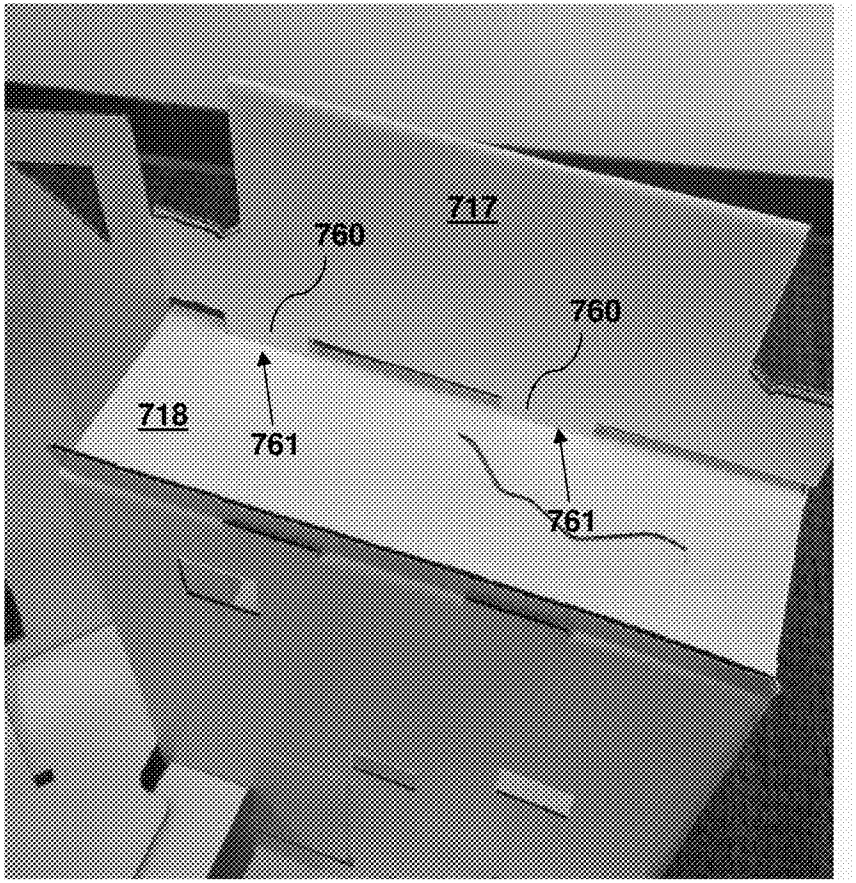
Figure 10H:
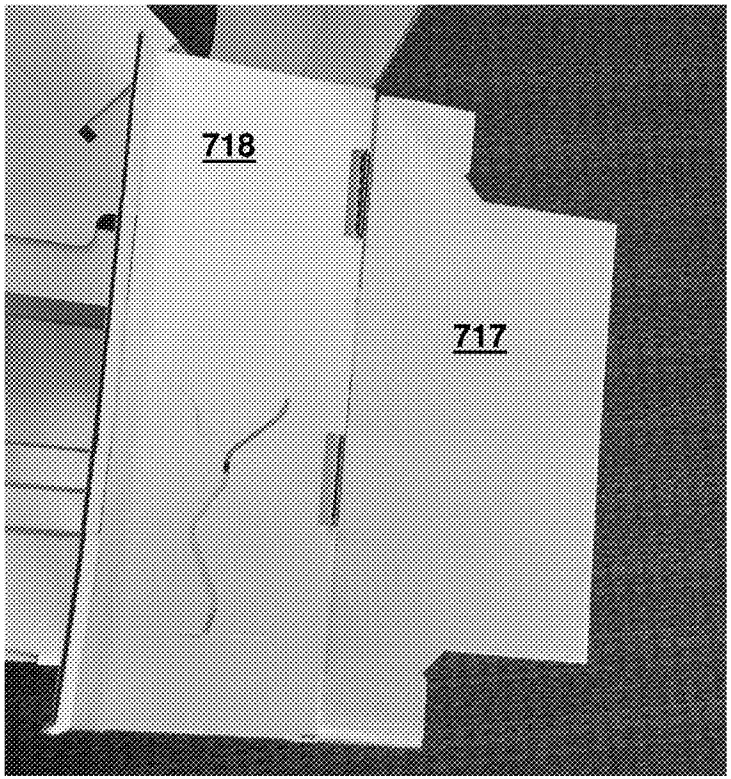
Figure 10G:
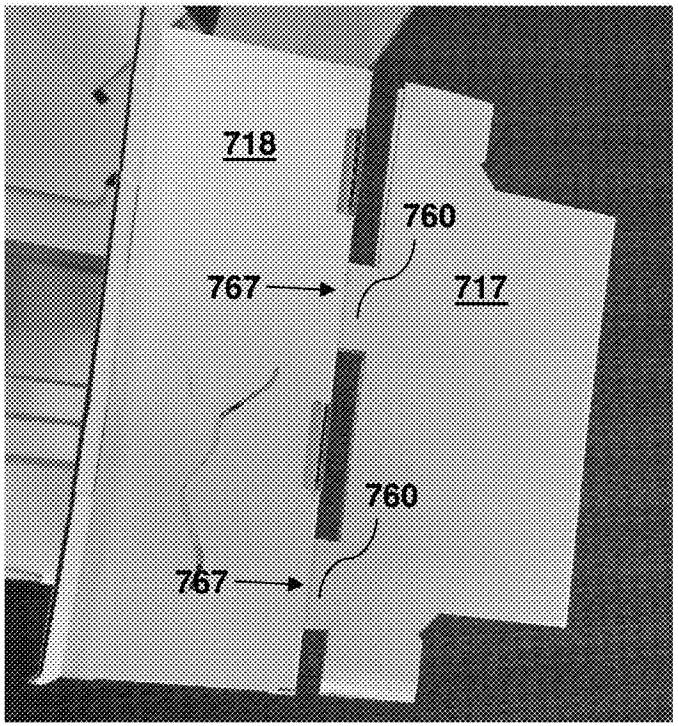
Figure 10J:
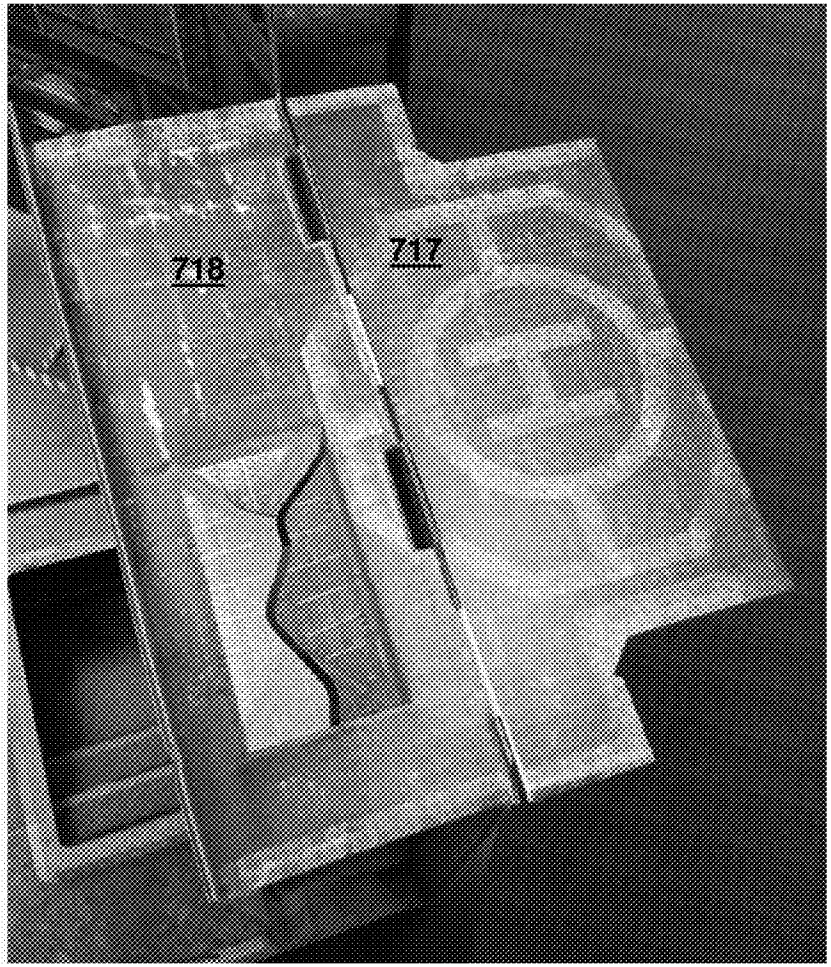
Figure 10I:
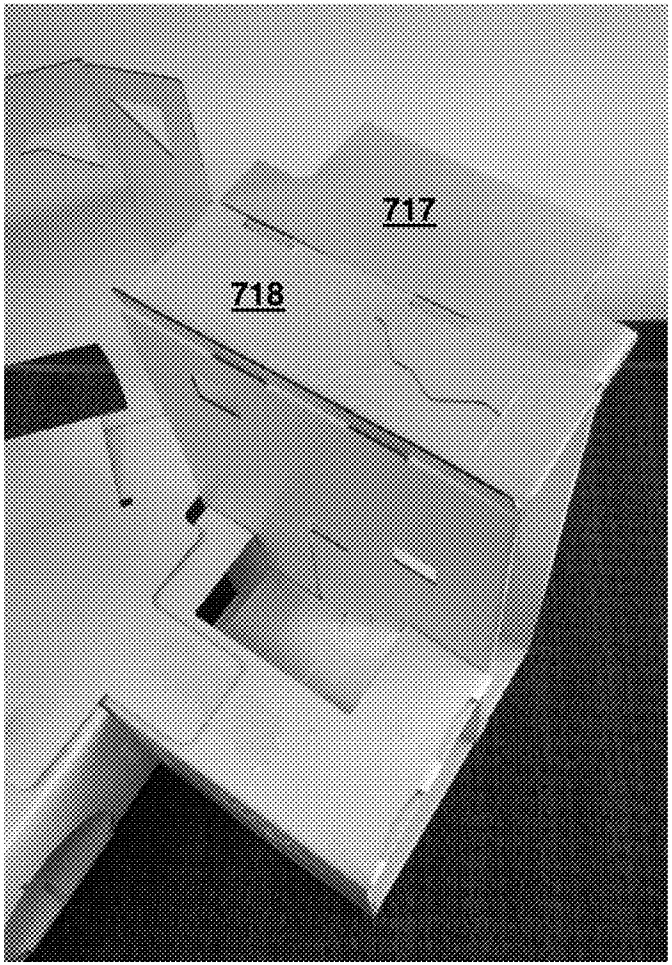

FIGS. 10A-10J provide additional details relating to optional right removable feature 717. With reference to FIG. 10A, it can be seen that the junction between the right foldout structure 718 and right panel 706 desirably uses a similar structure as shown in FIG. 9A, namely using a hinged joint 765 and a multilayer joint 762 where a portion of the foldout structure 718 overlaps the right panel 706. Further, FIG. 10A illustrates slots 761 and protruding members 763 similar in design to the slots and protruding members 761, 763 illustrated in FIG. 9A. One difference in FIG. 10A, however, is that the right removable feature 717 is configured to be reversible and coupled to or adjacent to the hinged joint 765 in two different orientations, with a first orientation being a vertical orientation and a second orientation being a horizontal orientation. This may be desirable, for example, to enable a child to change what is depicted by the right removable feature 717. For example, when the right removable feature 717 is positioned in a vertical orientation, as shown in FIG. 10F, the right removable feature 717 may comprise a depiction of a billboard or other vertical item. As another example, when the right removable feature 717 is positioned in a horizontal orientation, as shown in FIGS. 10H-10J, the right removable feature 717 may comprise a depiction of a helipad or other horizontal item.

With further reference to FIG. 10A, to facilitate the conversion of the right removable feature 717 from a vertical to a horizontal orientation, the structure comprises alternative slots 767. In this embodiment, the slots 767 are oriented with their opening directed horizontally instead of vertically like the slots 761. As can be seen in FIG. 10A, the alternative slots 767 are offset horizontally along the hinged joint 765 from the other slots 761. Although in some embodiments the alternative slots 761 could be in horizontal alignment with the other slots 761 along the hinged joint 765, such a design may reduce the structural integrity of the slots and reduce the ability for the slots to hold the right removable feature 717 in a sufficiently rigid manner. Accordingly, it can be desirable to use the embodiment illustrated in FIG. 10A, where the alternative slots 767 are offset from the other slots 761, enabling additional structural rigidity for each of the slots.

To facilitate using the two sets of offset slots, FIGS. 10B-10D illustrate additional features of the right removable feature 717, which also comprises offset tabs 760. With reference to FIG. 10B, the right removable feature 717 comprises a flat piece of corrugated cardboard that can be folded in half to form the right removable feature 717 and use. The right removable feature 717 comprises a first end 770 and a second end 772. The tabs 760 are offset toward the second end 772. The removable feature 717 may also have different scenes depicted on either side of the panel. Accordingly, when folded in one direction, as illustrated in FIG. 10C, one of those scenes is displayed, and the tabs 760 are offset in a first direction. When folded in the opposite direction, as illustrated in FIG. 10D, however, the other scene is displayed, and the tabs 760 are offset in a second direction. This allows for the removable feature 717 to be inserted in the vertical orientation, as illustrated in FIGS. 10E and 10F, when folded in one direction, and then inserted in the horizontal orientation, as illustrated in FIGS. 10G through 10J, when folded in the other direction. It should be noted that, for clarity of the structural features, most figures provided herewith illustrate a blank play structure. FIG. 10G, however, illustrates one example of photorealistic graphics that can be applied to such a play structure to imitate real-world items, such as a helipad.

Figure 11A:
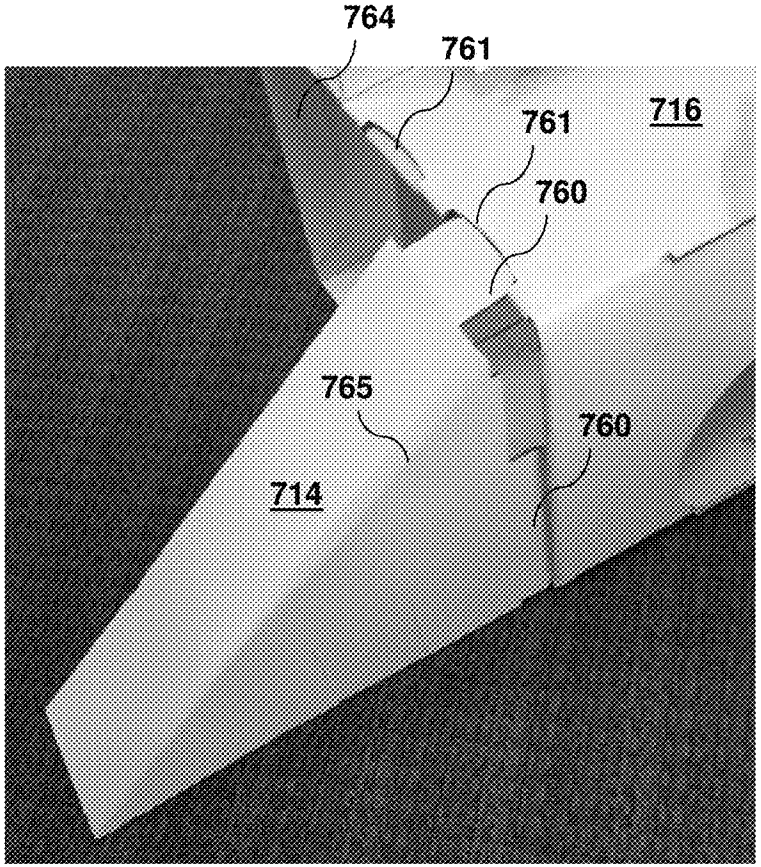

FIGS. 11A and 11B illustrate additional details of an optional ramp 714 that can be assembled with the portable folding play structure 700. In this example, the ramp 714 comprises a panel of corrugated cardboard that has been folded along joint 765. The ramp 714 comprises two protruding tabs 760. The top tab 760 is shown being inserted into a mating slot 761 in the left foldout structure 716. The bottom tab 760 of the ramp 714, in this example, is being shown inserted behind a front face of the foldout structure 716, instead of into a slot 761. In some embodiments, as with the right removable feature 717 described above, the ramps 714 may be configured to be inserted various ways or connected in various ways to the play structure. For example, FIG. 11A illustrates an additional slot 761 that has nothing being inserted into it, but that could optionally have a second ramp 714 coupled thereto. This may be desirable to, for example, create a wider ramp. Further, with reference to FIG. 11B, the foldout structure 716 comprises additional slots 761 on a front surface that can enable the ramp 714 to be coupled thereto and extend from the foldout structure 716 in a different orientation.

In some embodiments, the slots 761, such as the two slot 761 illustrated in FIG. 11A, may be formed by a flap of a panel of the foldout structure 716 that has been folded under (similar to the flap called out as element 764 in FIG. 11A, but underneath the horizontal panel that comprises the slots 761) and has openings 761 therein. If a flap of the panel is simply folded over and adhered or otherwise attached to the underside of the horizontal panel, however, there may be relatively little room within the slot 761 to allow the tab 760 to easily slide in and be pulled out. Accordingly, in some embodiments, a flap is folded over desirably with a double joint, meaning the flap is, for example, folded 90° along one fold axis, and then folded another 90° along a second fold axis that is parallel to the first fold axis but separated apart from the first fold axis a sufficient distance that, when the flap is adhered or otherwise connected to the underside of the panel, sufficient space is created between the flap and underside of the panel to allow tab 760 to be relatively easily inserted into the slots 761.

Although various embodiments disclosed herein describe optional removable features as attaching to the main structure of the play structure using tabs that insert into slots, various other embodiments may use other types of removable fasteners, such as, for example, magnets, mechanical fasteners, screws, bolts, nonpermanent adhesives, and/or the like.

Openings

It can be desirable for a children's three-dimensional play structure to have a plurality of openings and/or passages. Such openings and/or passages can provide places for children to pass toys through, cause toys to drop through, and/or the like, to increase their enjoyment in the playtime experience. It can also be desirable for one or more of the openings to be selectively closable and/or openable. Embodiments disclosed herein can comprise a plurality of openings for passing toys therethrough, with some of the openings being always open, and some comprising one or more movable panels that allow the opening to be selectively closed or open. In some embodiments, some or all of the openings (and the general size of the play structure and internal cavities) are designed to accommodate the size of a child's hand, arm, and/or typical action figures sizes, so that a child can pass a toy through the openings and move the toy around within various cavities of the assembly.

Figure 12A:
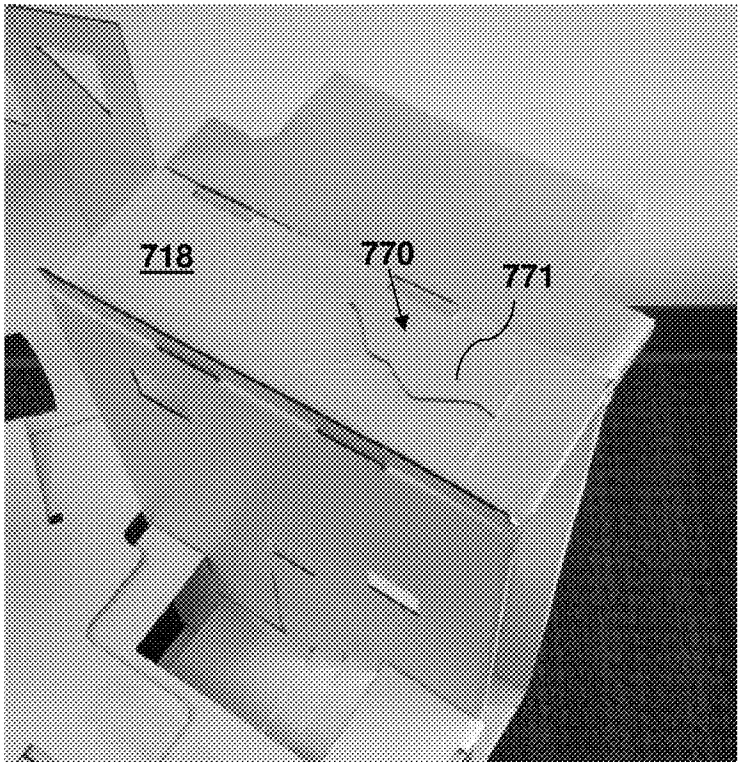
FIGS. 12A-12I illustrate various embodiments of openings in the embodiment of FIG. 7A that comprise one or more movable panels.
Figure 12B:
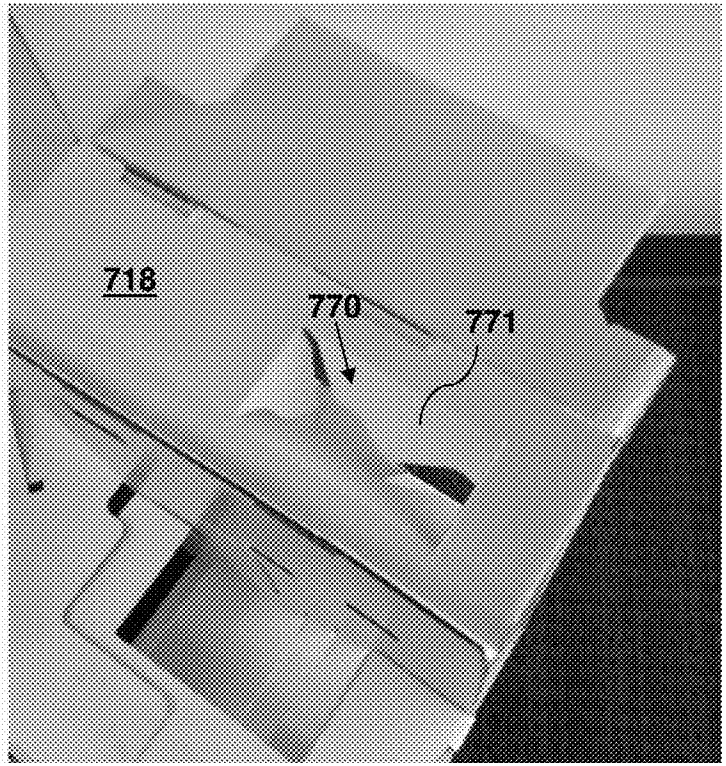
Figure 12D:
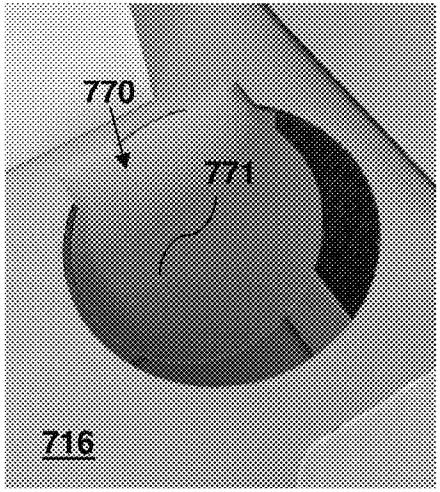
Figure 12E:
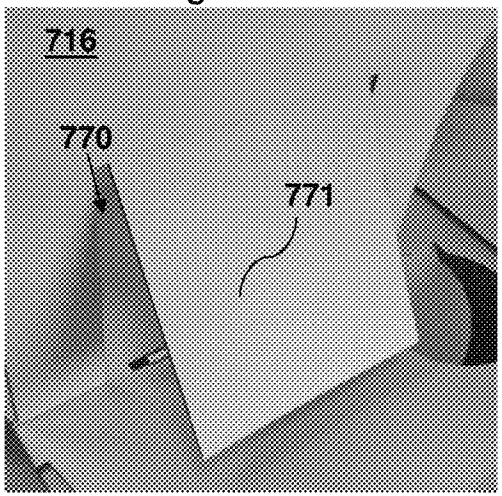
Figure 12C:
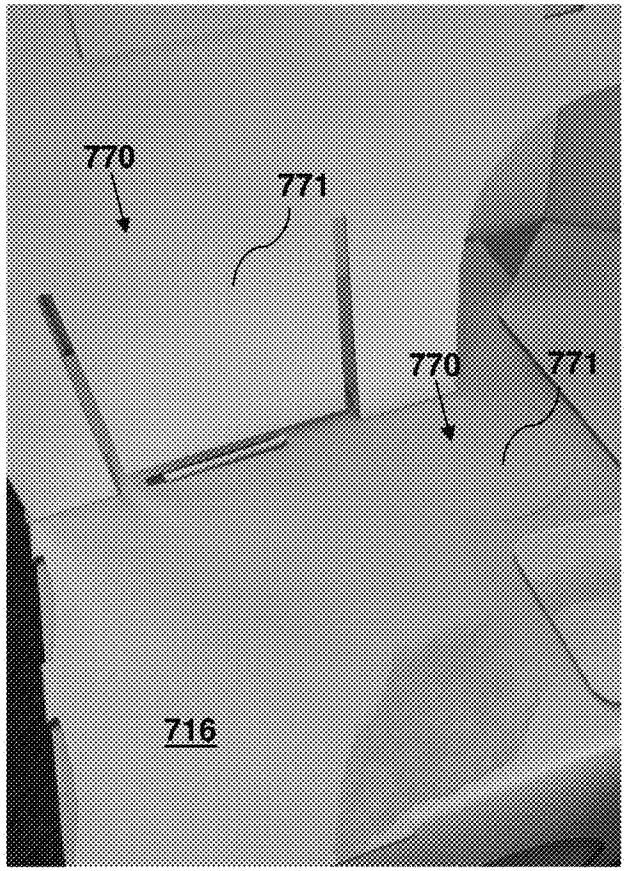
Figure 12G:
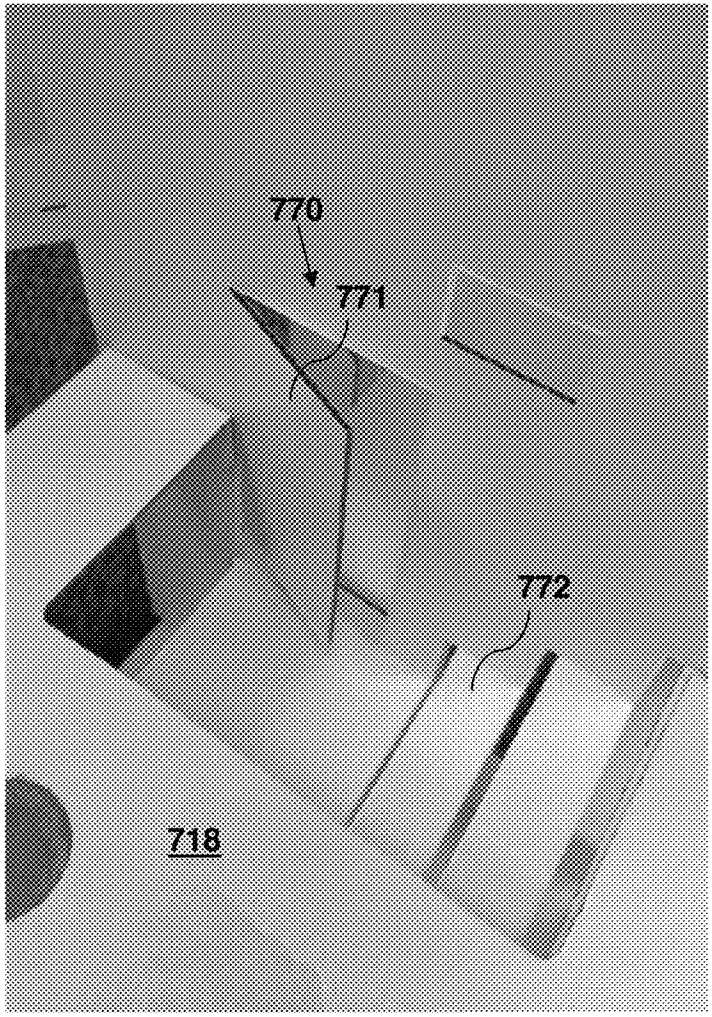
Figure 12F:
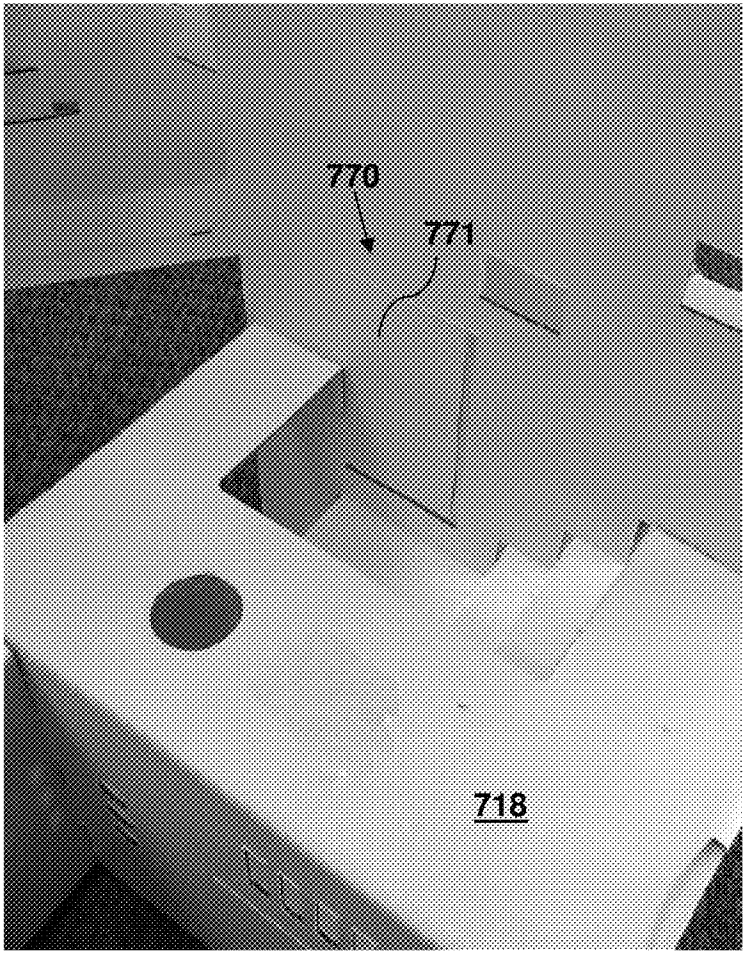
Figure 12I:
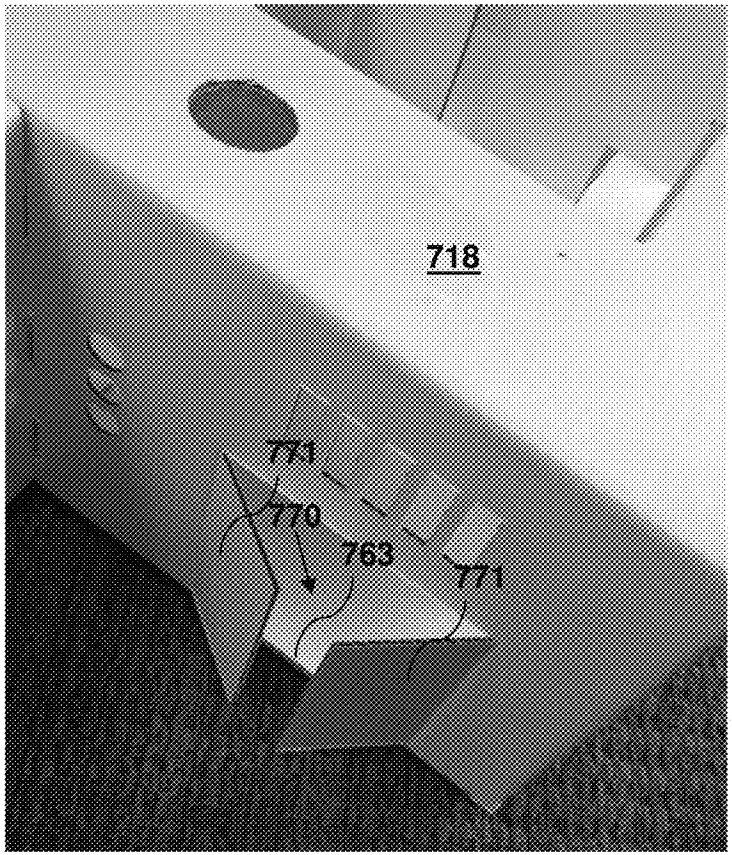
Figure 12H:
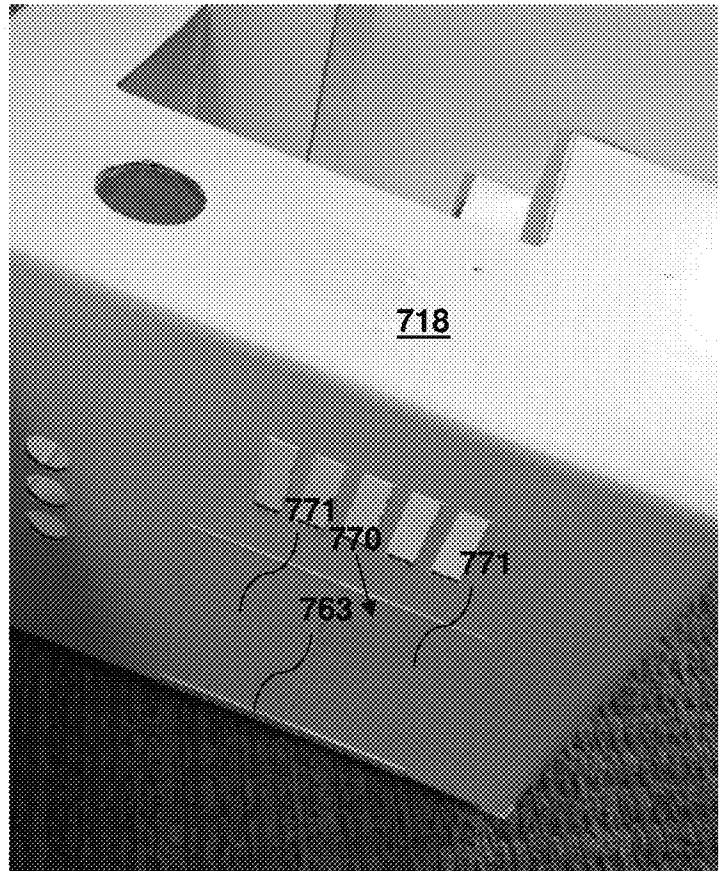

FIGS. 12A-12I illustrate a plurality of examples of openings 770 that comprise one or more movable panels 771 to enable the openings 770 to be selectively opened or closed. For example, FIGS. 12A and 12B illustrate a trap door opening 770 comprising a plurality of movable panels 771. FIGS. 12C-12E illustrates an opening 770 with a movable panel 771 that can simulate, for example, a sewer cover or trapdoor, and also a movable panel 771 that can simulate a garage door or similar. FIGS. 12F and 12G illustrate an opening 770 and movable panel 771 that can simulate a door. FIGS. 12F and 12G also illustrate trusses or members 772 that connect one panel of the foldout structure 718 to another panel of the foldout structure 718. In this embodiment, the members 772 are configured to simulate stairs. The members 772 can also perform a functional purpose, however, such as by increasing the rigidity of the foldout structure 718 by connecting various panels of the folder structure 718 together. FIGS. 12 H and 12 I illustrate an opening 770 and two movable panels 771 that can simulate, for example, a double door.

Another feature that can be seen in FIG. 12C is that the movable panel 771 is sized such that there is a gap around the perimeter of the panel. This gap can perform multiple purposes. For example, the gap can be sized such that a child's finger will tend to not get stuck in between the movable panel or flap 771 and the adjacent structure or panel. As another example, it can be desirable for the perimeter of the movable panel 771 to not rub against adjacent components when the movable panel is moved. This makes it easier for the panel to move and can provide for a more enjoyable experience. Such gaps can be used in various other components of the design that are movable. For example, FIG. 12A illustrates a gap in the movable panel 771, and FIGS. 12F and 12G illustrate a gap next to movable panel 771 and on either side of the stairs 772. The gaps adjacent the stairs 772 can be desirable, for example, to allow easier collapsing and opening of the assembly, because the edges of the stairs 772 will desirably not rub against the adjacent stairs or other panels when collapsing and opening. These concepts can also be utilized in various other locations of the assembly, specifically in areas where one panel moves relative to another panel in close proximity.

Although not every single opening in the play structure 700 is called out with an element number 770 in the figures provided herewith, it can be seen that various other openings can be provided.

Audio and/or Visual Interaction

In some embodiments, the portable folding play structure 700 further comprises an audio and/or visual component that electronically reacts to one or more movable panels 771 being moved. For example, in any of the embodiments illustrated in FIGS. 12A-12I, the play structure may comprise an electronic audio component that is caused to be triggered by movement of one or more of the movable panels 771, and will play an audio sound clip or similar when it is triggered. As one example, when the movable panel 771 shown in FIG. 12G is opened, the system could be configured to play a sound of a door creaking, a car engine revving in a garage, and/or the like. As another example, when the movable panels 771 illustrated in FIG. 12B are opened, the system can be configured to play a sound of a person yelling, such as to simulate what an action figure might yell as he or she falls through a trap door. Various other sounds may be configured to be played upon opening a movable panel, pressing a butting, moving another part of the structure, and/or the like, such as police sirens, hazardous spill sirens, and/or other sound effects. In some embodiments, visual elements can also be included, such as lights that might blink when a movable panel is moved. In some embodiments, the electronics and/or power source required to play audio and/or generate light may be embedded in the structure of the collapsible play structure, such as between two layers of corrugated cardboard. In some embodiments, the electronics and/or power source may be coupled to a wall of the play structure.

Folded Joint Orientations

Figure 13B:
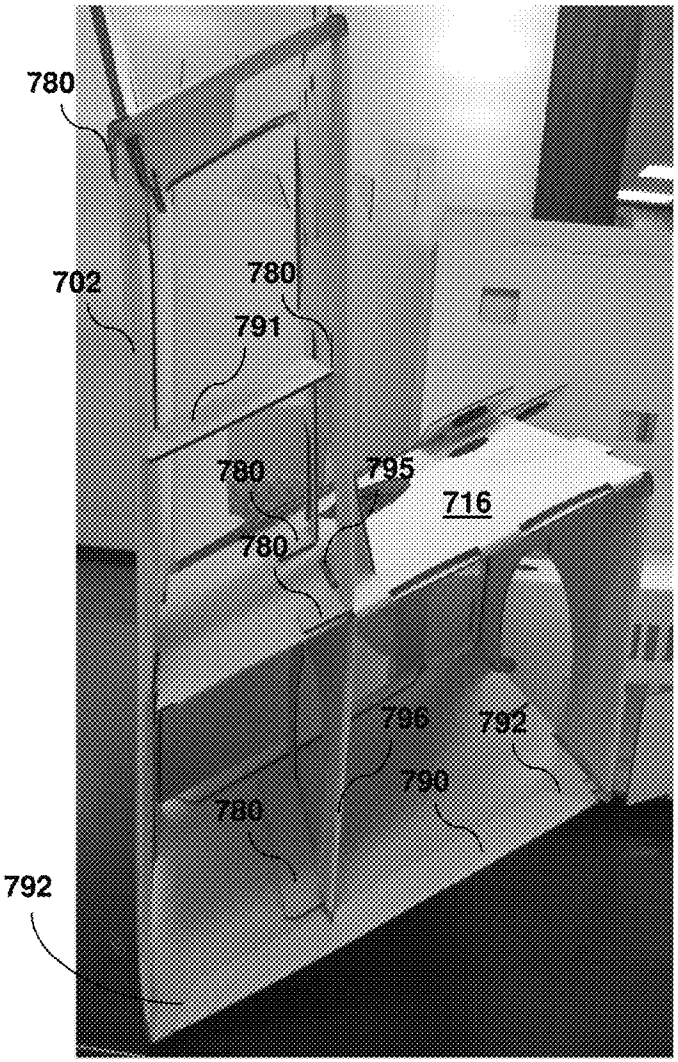
FIG. 13B illustrates the folding joints of FIG. 13A in a partially collapsed configuration.
Figure 13A:
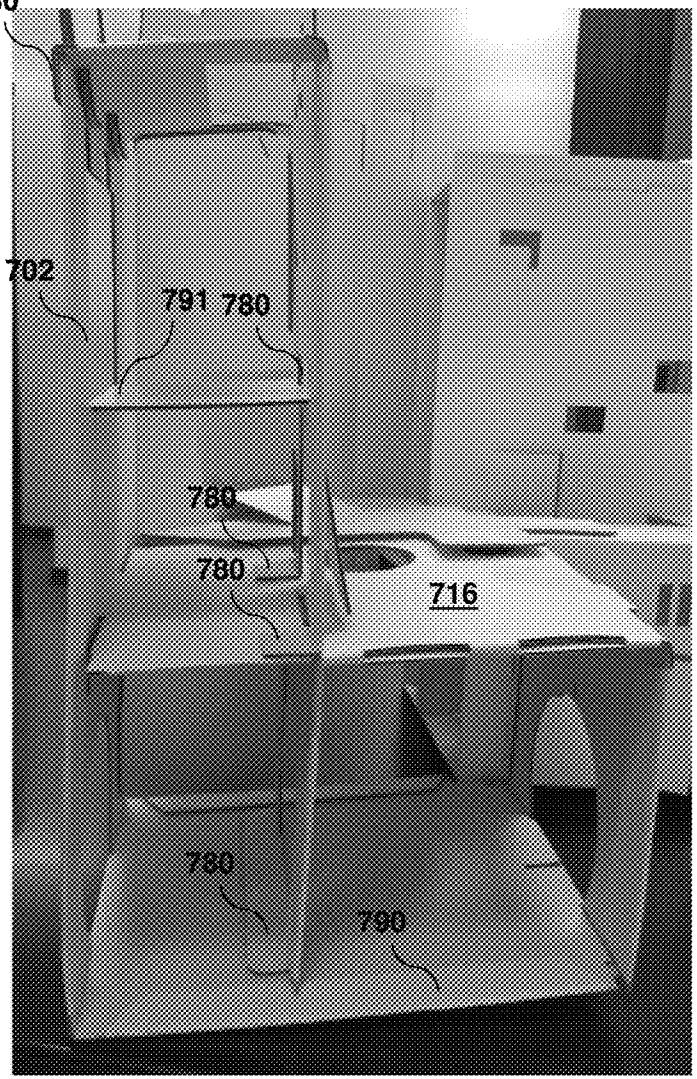
FIG. 13A illustrates some of the folding joints of the embodiment of FIG. 7A in an open configuration.

In some embodiments of folding play structures disclosed herein, it can be desirable to orient hinge joints that fold and unfold during the process of opening the assembly or closing the assembly to more easily facilitate collapsing the assembly. For example, some of the hinge joints in the folding play structure 700 are formed by one panel having a protruding tab, flap, or similar that is folded over and adhered to another panel. For example, FIGS. 13A and 13B illustrate multiple areas where this is the case, with the folded over tabs called out by reference number 780. FIG. 13A illustrates a side view of the left foldout structure 716 in the substantially folded out or open orientation. In such a configuration, the various tabs 780 are oriented at approximately a right angle or 90° orientation with respect to the panel that the tab 780 protrudes from. Although FIGS. 13A and 13B illustrate an example where the folded over tabs or flaps 780 do not pass through the panel they are adhered to, other embodiments may be configured such that the tabs or flaps 780 pass through a hole or slot in the panel and then are folded over and adhered to the underside of the panel. Such a configuration could have multiple benefits, such as hiding the tab 780 from view and/or helping with alignment of the tab during the manufacturing assembly process. One reason it can be desirable to use the configuration shown in FIGS. 13A and 13B, however, is that the configuration shown in FIGS. 13A and 13B may allow for a flatter and/or less stressed fold joint when in the collapsed position.

When the foldout structure 716 is transition to the collapsed configuration, it can be desirable to cause those tabs 780 to open up into a more obtuse angle instead of to close up into a more acute angle. Because the tabs 780 are desirably formed by folding over a portion of the panel they are a part of, they will tend to be more resistant to folding into a more acute angle than to unfolding into a more obtuse angle. Accordingly, orienting these tabs so that they form a more obtuse angle when collapsing the foldout structure 716 can make it easier to collapse the structure and can also enable a more flat compact structure in the closed or collapsed configuration. Other benefits are that such configurations can prevent tearing and prevent bad alignment of the assembly. For example, at any place where additional stress is introduced (such if the tab were bent into a more acute angle instead of obtuse angle during collapsing of the assembly), the panels may have a tendency to create "false scores" to relieve the pressure. But these false scores can lead to misaligned panels and reduction in rigidity and/or strength of the assembly. Accordingly, it can be desirable to reduce such stresses, for example, by orienting the folded tabs 780 to "open up" into an obtuse angle when collapsing the assembly.

FIG. 13B illustrates the foldout structure 716 in a partially collapsed configuration, and it can be seen in this figure that the tabs 780 are forming obtuse angles as the structure 716 is collapsed.

FIGS. 13A and 13B also show additional details of edges of the assembly, such as edge 790 that comprise a folded over flap. Such folded over flap can increase the structural rigidity of the edge, in addition to increasing the aesthetics of the edge. While folding over a flap at the transverse edge of a panel, such as flap 790, can increase the structural rigidity of the panel and allow the play structure 700 to be more rigid and/or to more easily maintain its alignment in the open position, in some embodiments, it can be desirable to have the folded over flap not extend the entire length of the panel. For example, as shown in FIG. 13B, the ends 792 of the flap 790 do not extend all the way to the ends of the panel that the flap 790 is formed as a part of. In this embodiment, the ends 792 are cut at an angle, approximately 45°, although other embodiments could comprise ends 792 cut at different angles. By having such a configuration, the play structure 700 can be relatively rigid and aligned when standing or set up in the open position, yet can also relatively easily fold up into the collapsed position. If the flap 790 were to extend all the way to the ends of the panel, when the play structure is folded up into the collapsed position, those ends of the flap could interfere with adjacent flaps on adjacent panels and create bulges in the collapsed assembly that can both weaken the structure and cause the collapsed structure to be thicker than desired. These bulges and increased thickness can be cumulative, since there could be several joints having such a situation in close proximity to one another. Such interferences of the flaps at the joints can also cause the play structure to require additional force to close into the collapsed position, which can cause additional bends or deformations to be introduced at locations that were not intended to be bent, thus weakening structure. In such a case, the rigidity and/or ability to stand straight in an ideal expanded alignment can be compromised. Accordingly, it can be desirable to include folded over flaps 790 along various edges of panels of the structure, but to also not have the flap 790 extend along the entire panel, for the reasons given above.

Another feature that can be seen in FIG. 13B is that a small protruding tab 795 of the vertical panel 796 can be seen protruding into the horizontal panel that is adjacent the tab 795. Such a tab 795 can help in the assembly process, such as by positioning the top of panel 796 while the bottom portion, such as the tab or flap 780, is glued into place. In some embodiments, the tab 795 is not glued or otherwise fastened to the horizontal panel. Rather, the tab 795 is relatively loosely fit into its mating slot which holds the top of the panel 796 in place. Such a configuration can be desirable, for example, to enable, among other things, accounting for manufacturing tolerances, allowing the top of the panel 796 to move somewhat with respect to the horizontal panel when the assembly is being converted from the collapsed position to the open position or vice versa, and/or the like. Such a design, namely including a tab that is floating in a mating slot, instead of being adhered to or otherwise fastened to another component, can also be used in various other portions of the design.

FIGS. 13A and 13B also show one of many horizontal panels 791 that can help to increase the bending rigidity of the vertical panels to which they are attached at either end.

Spring Open Features

In some embodiments, it can be desirable to include one or more features that facilitate more automated opening of the play structure 700. As described above, in some embodiments, the foldout structures, such as the foldout structure 716, can be configured to automatically open via gravity when the play structure is stood up. However, to provide quicker and/or more reliable automatic setup, one or more springs may be included that cause the foldout structures, such as foldout structures 716 and 718, to automatically spring open when the play structure is unfolded into, for example, the positions shown in FIGS. 7D and 7E, regardless of the orientation of the structure with respect to gravity.

Figure 14:
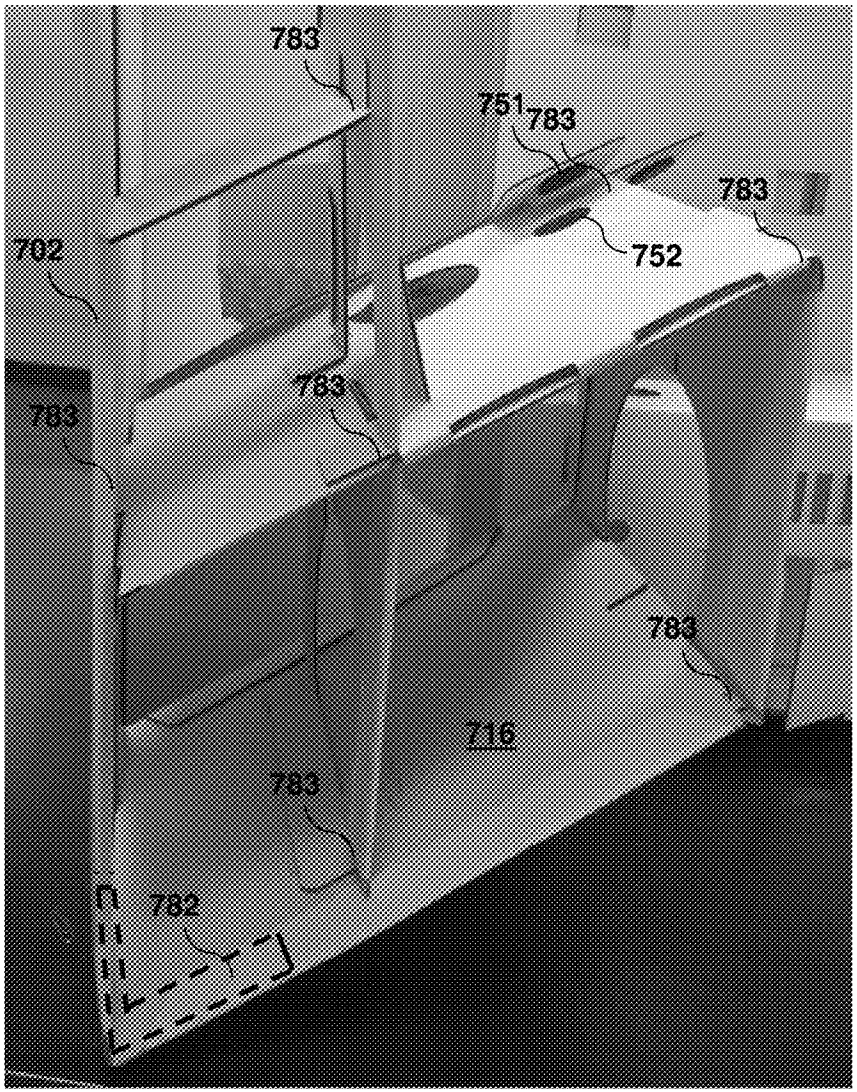
FIG. 14 illustrates an embodiment of a portable folding play structure comprising a spring.

FIG. 14 illustrates one example of including a spring 782 in a portable folding play structure as described herein. In this embodiment, the spring 782 comprises a pre-stressed or bent piece of metal that is positioned at a bottom corner of the play structure 700, and specifically at one of the hinged joints between the left panel 702 and left foldout structure 716. The spring 782 in this embodiment can, for example, have a relaxed state or position that is approximately a right angle. Accordingly, when the foldout structure 716 is collapsed, the spring 782 will also be collapsed and provide a torsional biasing force between the left panel 702 and left full of structure 716 that tends to cause the foldout structure 716 to move into the open configuration. Accordingly, once the play structure 700 is unfolded into the orientation illustrated in FIG. 7E, the left foldout structure 716 can automatically pop out under the power of the spring 782.

Although FIG. 14 illustrates one specific example of a piece or strip of metal forming a torsional spring 782, various other types of springs may be used. For example a coil spring may be used, a spring may be positioned at various other locations to perform a similar function, and or the like. For example, another location such a spring may be used is near the element 752 illustrated in FIG. 14. One reason it could be desirable to position the spring 782 at that location, is that the spring 782, if it is formed of a magnetic material, may perform double duty by also providing a surface that the magnet 751 can mate to. Element number 783 illustrates various other non-limiting examples of joint or fold locations where a similar spring 782 could be used. Further, anywhere in the assembly where a fold occurs or two panels change orientation with respect to one another when changing from the collapsed configuration to the open configuration could include a spring that causes the panels to move to the open configuration.

It is contemplated that various combinations or subcombinations of the specific features and aspects of the embodiments disclosed above may be made and still fall within one or more of the inventions. Further, the disclosure herein of any particular feature, aspect, method, property, characteristic, quality, attribute, element, or the like in connection with an embodiment can be used in all other embodiments set forth herein. Accordingly, it should be understood that various features and aspects of the disclosed embodiments can be combined with or substituted for one another in order to form varying modes of the disclosed inventions. Thus, it is intended that the scope of the present inventions herein disclosed should not be limited by the particular disclosed embodiments described above. Moreover, while the inventions are susceptible to various modifications, and alternative forms, specific examples thereof have been shown in the drawings and are herein described in detail. It should be understood, however, that the inventions are not to be limited to the particular forms or methods disclosed, but to the contrary, the inventions are to cover all modifications, equivalents, and alternatives falling within the spirit and scope of the various embodiments described and the appended claims. Any methods disclosed herein need not be performed in the order recited. The methods disclosed herein include certain actions taken by a practitioner; however, they can also include any third-party instruction of those actions, either expressly or by implication. Any ranges disclosed herein also encompass any and all overlap, sub-ranges, and combinations thereof. Language such as "up to," "at least," "greater than," "less than," "between," and the like includes the number recited. Numbers preceded by a term such as "approximately", "about", and "substantially" as used herein include the recited numbers, and also represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount.

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment. The headings used herein are for the convenience of the reader only and are not meant to limit the scope of the inventions or claims.

What is claimed is:

1. A collapsible play structure having a collapsed configuration and an opened configuration, the collapsible play structure comprising:

a left panel having a back surface, a front surface, a horizontal axis, and a vertical axis;

a left fold out structure coupled to the left panel, the left fold out structure comprising one or more members rotatably coupled to the left panel to be rotatable about an axis parallel with the horizontal axis of the left panel;

a right panel having a back surface, a front surface, a horizontal axis, and a vertical axis;

a right fold out structure coupled to the right panel, the right fold out structure comprising one or more members rotatably coupled to the right panel to be rotatable about an axis parallel with the horizontal axis of the right panel;

a center panel having a back surface and a front surface, the center panel rotatably coupled to the left panel and the right panel in an orientation that aligns the vertical axes of the left panel and the right panel in a parallel alignment, wherein the center panel is rotatably coupled to the left panel via a left hinge panel, and the center panel is rotatably coupled to the right panel via a right hinge panel; and a connecting panel rotatably coupled to the center panel by a hinge joint that allows the connecting panel to rotate with respect to the center panel about an axis that is perpendicular to the vertical axes of the left panel and right panel, wherein, in the opened configuration, the left fold out structure and right fold out structure are coupled together by at least one releasable joint, and wherein, in the opened configuration, the connecting panel is coupled to the left fold out structure by at least one releasable joint, and the connecting panel is coupled to the right fold out structure by at least one releasable joint.

2. The collapsible play structure of claim 1, wherein the left and right hinge panels each comprise a width, and one of the left and right hinge panels is wider than the other of the left and right hinge panels.

3. The collapsible play structure of claim 2, wherein the widths of the left and right hinge panels are sufficiently large to enable the back surface of the left panel, the back surface of the center panel, and the back surface of the right panel to all be in a parallel alignment when the collapsible play structure is in the collapsed configuration.

4. The collapsible play structure of claim 1, wherein:

the left fold out structure is positioned to be collapsed toward the front surface of the left panel when the collapsible play structure is in the collapsed configuration, and to be expanded away from the front surface of the left panel when the collapsible play structure is in the opened configuration, and the right fold out structure is positioned to be collapsed toward the front surface of the right panel when the collapsible play structure is in the collapsed configuration, and to be expanded away from the front surface of the right panel when the collapsible play structure is in the opened configuration.

5. The collapsible play structure of claim 1, wherein each panel comprises corrugated cardboard.

6. A portable folding play structure comprising:

a plurality of sheets of corrugated cardboard;

said sheets die cut and scored to create a foldable structure that when unfolded creates a play structure;

said play structure including a left side wall, a center wall and a right-side wall;

said left side wall and said right side wall each held to said center wall by left and right integral hinge strips formed by scoring said corrugated cardboard;

said left and right side walls including fold down structures that create multi-tiered play surfaces;

said center wall including a fold down X member; and said X member having scored ends that insert into slots in horizontal tiers on said left and right walls causing said left and right walls to be locked in place in a right-angle condition with relation to each other.

7. A portable folding play structure as claimed in claim 6, wherein said fold down structures automatically fall into place by gravitational force.

8. A portable folding play structure as claimed in claim 6 wherein said right side wall and said left side wall can fold over said center wall via said hinges to form a relatively flat compact structure that is ideal for storage and shipping.

9. A portable folding play structure as claimed in claim 6 further comprising a plurality of stairs, ramps, windows, doors and tunnels formed by scores in said sheets of corrugated cardboard.

* * * * *